US009651911B2

(12) United States Patent
Kanamoto

(10) Patent No.: US 9,651,911 B2
(45) Date of Patent: May 16, 2017

(54) PRINT APPARATUS, METHOD FOR CONTROLLING PRINT APPARATUS, AND STORAGE MEDIUM

(71) Applicant: CANON KABUSHIKI KAISHA, Tokyo (JP)

(72) Inventor: Yoshiji Kanamoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/968,748

(22) Filed: Dec. 14, 2015

(65) Prior Publication Data

US 2016/0187832 A1 Jun. 30, 2016

(30) Foreign Application Priority Data

Dec. 25, 2014 (JP) ..... 2014-263182

(51) Int. Cl.
*G03G 15/00* (2006.01)

(52) U.S. Cl.
CPC ..... *G03G 15/6541* (2013.01); *G03G 15/6544* (2013.01); *G03G 2215/00818* (2013.01); *G03G 2215/00827* (2013.01); *G03G 2215/00864* (2013.01)

(58) Field of Classification Search
CPC ..... G03G 2215/00822; G03G 2215/00828; G03G 2215/00831; G03G 2215/00835; G03G 2215/00839; G03G 2215/00843; G03G 2215/00848; G03G 2215/00818; G03G 2215/00864; G03G 15/6541; G03G 15/6544; B65H 37/04; B65H 2301/43828; B65H 2801/27; B42B 5/00; B42B 4/00
See application file for complete search history.

(56) References Cited

U.S. PATENT DOCUMENTS 5,323,221 A * 6/1994 Tomimori ..... G03G 15/6582 399/2
6,325,585 B1 * 12/2001 Sasaki ..... B26D 7/24 101/485

(Continued)

FOREIGN PATENT DOCUMENTS

CN 103287118 A 9/2013
CN 103287131 A 9/2013

(Continued)

*Primary Examiner* — David Banh
(74) *Attorney, Agent, or Firm* — Canon USA, Inc., IP Division

(57) ABSTRACT

A print apparatus that binds sheets at corners includes printing images onto the sheets, performing binding processing at specified corners using any of a first binding unit that performs the binding processing by being displaced to a plurality of positions and a second binding unit that performs the binding processing at a fixed single position, reversing the sheets via a conveyance path provided for reversing the sheets, and controlling permitting execution of the binding processing using the first or the second binding unit in a case where the sheets to be used are sheets of a type permitted to be reversed, and permitting execution of the binding processing using the first binding unit while prohibiting execution of the binding processing with use of the second binding unit in a case where the sheets to be used are sheets of a type prohibited from being reversed.

10 Claims, 18 Drawing Sheets

(56) References Cited

U.S. PATENT DOCUMENTS

| | | | | |
|---|---|---|---|---|
| 2011/0074081 | A1* | 3/2011 | Hirabayashi | B42C 1/125 270/58.12 |
| 2011/0236158 | A1* | 9/2011 | Shiraishi | B31F 5/027 412/33 |
| 2011/0304090 | A1* | 12/2011 | Kimura | G03G 15/6541 270/58.11 |
| 2012/0034009 | A1* | 2/2012 | Sato | B65H 37/04 399/408 |
| 2012/0304090 | A1 | 11/2012 | Waltman | |
| 2015/0063951 | A1* | 3/2015 | Kurohata | B42C 1/12 412/1 |

FOREIGN PATENT DOCUMENTS

| | | | |
|---|---|---|---|
| CN | 103802490 | A | 5/2014 |
| CN | 103847251 | A | 6/2014 |
| JP | 2005-88375 | A | 4/2005 |

* cited by examiner

PRINT APPARATUS, METHOD FOR CONTROLLING PRINT APPARATUS, AND STORAGE MEDIUM

BACKGROUND

Field

Aspects of the present invention generally relate to a print apparatus that carries out a print job to which binding processing is set.

Description of the Related Art

Conventionally, there has been known binding processing for aligning a plurality of sheets with data printed thereon and then binding them together, as one of post-processing functions performable by print apparatuses. In the early days, the print apparatuses used to be unequipped with a mechanism for displacing a binding unit for realizing the binding processing, and therefore used to be only able to perform the binding processing at a fixed single position. On the other hand, it is known to allow the binding processing to be performed at each corner of a printout by combining an image rotation with switching between normal order printing, which prints pages sequentially, starting from a first page, and reverse order printing, which prints pages sequentially, starting from a last page (for example, Japanese Patent Application Laid-Open No. 2005-88375).

Further, it is also known to configure the binding unit for realizing the binding processing to be displaceable, thereby displacing the binding unit to a binding position specified by a user to bind a sheet bundle there.

Various binding methods have been contrived as a binding method for binding the sheet bundle, and examples thereof include a binding method that binds the sheet bundle with use of a generally known staple, a binding method that binds the sheet bundle by welding toner onto the binding position, and a binding method that binds the sheet bundle without use of a binding member such as a staple for stapling.

Providing the print apparatus with a plurality of binding units has been conceived as a measure to expand the binding function performable by the print apparatuses. One possible configuration in this case is to mix the binding unit capable of performing the binding processing at a plurality of positions by being displaced, and the binding unit configured to perform the binding processing at a fixed position, according to a space in the apparatus where the binding units are mounted, cost, and the like.

Now, the print apparatuses can reverse a sheet via a conveyance path provided for reversing the sheet in terms of a back side and a front side thereof. However, the sheet may be wrinkled and/or bent due to a curvature or a bend of the conveyance path and/or under an influence of a roller, resulting in a reduction in a quality of the printout, depending on a type of the sheet. Therefore, the print apparatuses should control an operation so as to refrain from reversing such a sheet.

Then, if the sheets are bound together by the binding unit capable of performing the binding processing at the plurality of positions by being displaced, the binding processing can be performed at each corner or on each side of the printout without requiring the sheets to be conveyed via the conveyance path that reverses the sheets, provided that this is one-sided printing.

On the other hand, if the sheets are bound together by the binding unit configured to perform the binding processing at the fixed position, the sheets may have to be subject to the reverse order printing. Therefore, even at the time of the one-sided printing, the sheets should be reversed via the conveyance path that reverses the sheets in terms of the front sides and the back sides thereof. However, the quality of the printout may reduce, if the bound sheets are sheets of a type that causes the sheets to be wrinkled and/or bent due to the conveyance thereof through the conveyance path provided for reversing the sheets, like the above-described sheet type.

SUMMARY

Aspects of the present invention are generally directed to performing control according to a binding position and a binding unit that performs specified binding processing, thereby preventing the reduction in the quality of a printout.

According to an aspect of the present invention, a print apparatus that binds sheets at corners thereof after images are printed onto the sheets, includes a print unit configured to print images onto the sheets, a sheet binding unit configured to perform binding processing at specified corners using any of a first binding unit that performs the binding processing by being displaced to a plurality of positions, and a second binding unit that performs the binding processing at a fixed single position, a reversing unit configured to reverse the sheets via a conveyance path provided for reversing the sheets, and a control unit configured to cause the binding processing to be performed on the sheets that are not reversed by the reversing unit in a case where the binding processing is performed at predetermined corners using the first binding unit, and cause the binding processing to be performed on the sheets that are reversed by the reversing unit in a case where the binding processing is performed at the predetermined corners using the second binding unit. The control unit further permits execution of the binding processing using the first binding unit or the second binding unit in a case where the sheets to be used when the print unit prints the images are sheets of a type permitted to be reversed by the reversing unit, and permits execution of the binding processing using the first binding unit while prohibiting execution of the binding processing with use of the second binding unit in a case where the sheets to be used when the print unit prints the images are sheets of a type prohibited from being reversed by the reversing unit.

Further features of the present disclosure will become apparent from the following description of exemplary embodiments with reference to the attached drawings.

DESCRIPTION OF THE EMBODIMENTS

In the following description, exemplary embodiments of the present invention will be described in detail with reference to the drawings. However, the exemplary embodiments that will be described below do not limit aspects of the present invention defined according to the claims. Further, not all of combinations of features that will be described in the exemplary embodiments are necessarily essential to a solution of aspects of the present invention.

Figure 1:
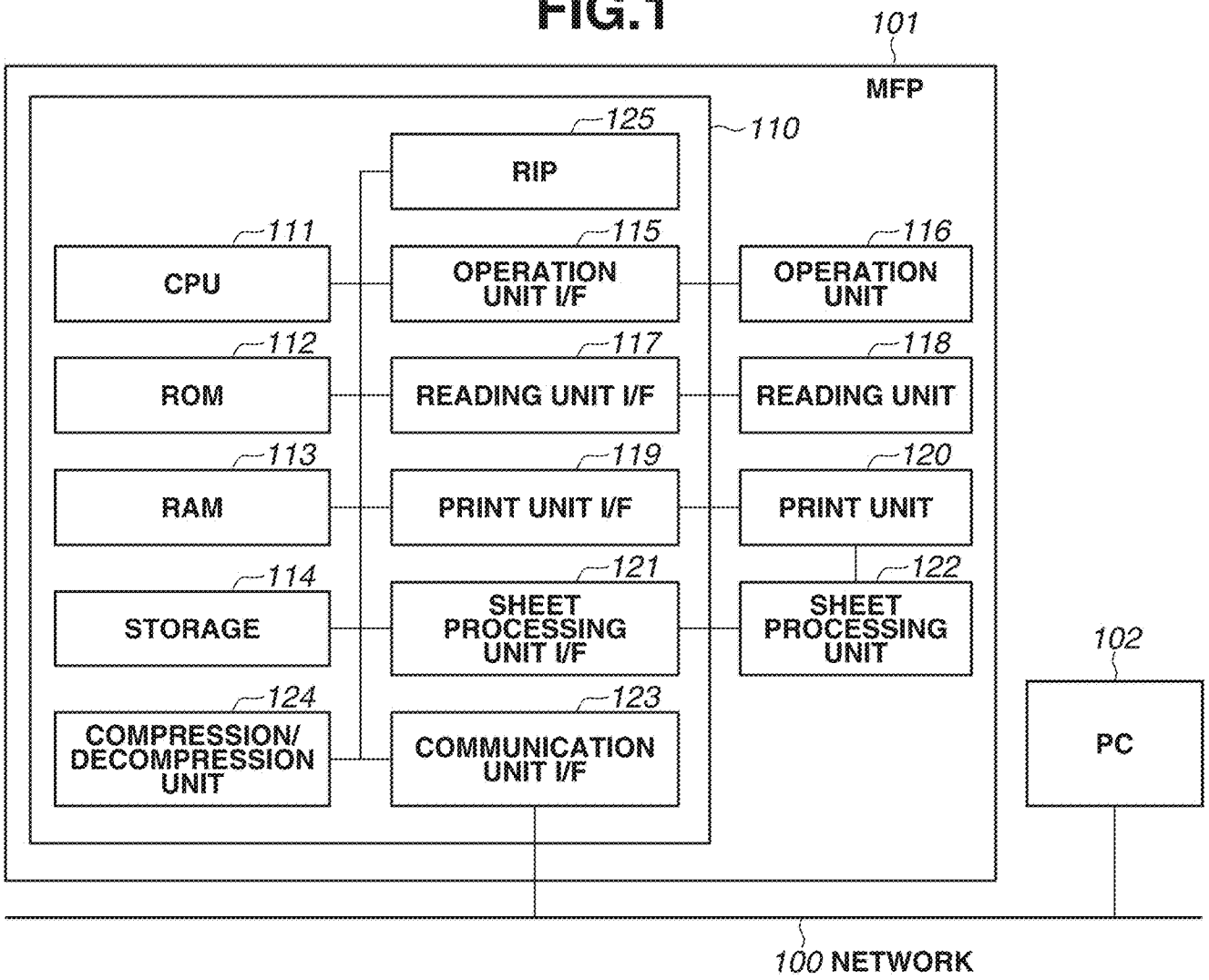
FIG. 1 is a block diagram illustrating a print processing system.

A first exemplary embodiment will be described. FIG. 1 is a block diagram illustrating a print processing system according to the present exemplary embodiment. In the present exemplary embodiment, a multifunction peripheral (MFP) 101 and a personal computer (PC) 102 will be described as one example of a print apparatus and one example of an information processing apparatus, respectively. The MFP 101 and the PC 102 are communicably connected to each other via a network 100.

In FIG. 1, the print processing system is illustrated as including a single information processing apparatus by way of example, but the MFP 101 and a plurality of information processing apparatuses may be communicably connected to each other via the network 100. Further, the print processing system according to the present exemplary embodiment is illustrated as including the MFP 101 and the PC 102 by way of example, but is not limited thereto. For example, the MFP 101 alone may be referred to as the print processing system.

First, the PC 102 will be described. The PC 102 can execute various kinds of programs, such as an application program. Further, the PC 102 includes a printer driver installed therein, which has a function of converting a print content into print data to be transmitted to the MFP 101. A user who wants to print data can issue a print instruction from various kinds of applications and the like. The printer driver can convert the data output from the application into the print data interpretable by the MFP 101 based on the print instruction, and transmit the print data to the MFP 101 connected to the network 100.

In the present exemplary embodiment, the PC 102 is indicated as one example of the information processing apparatus. However, the information processing apparatus may be, for example, a portable information terminal, such as a smart-phone and a tablet terminal. The method for transmitting the print data to the print apparatus can be arbitrarily modified. The PC 102 may be configured to transmit the print data to the print apparatus via an application or a driver for printing, or may be configured to transmit the print data to the print apparatus via a cloud server.

Next, the MFP 101 will be described. The MFP 101 has a reading function of reading an image on a sheet, and a print function of printing an image onto a sheet. Further, the MFP 101 has a post-processing function of binding together a plurality of sheets with images printed thereon, and aligning the plurality of sheets with one another. Types of the sheet include paper, such as plain paper and thick paper, an overhead projector (OHP) sheet, and the like.

In the present exemplary embodiment, the MFP 101 is described as one example of the print apparatus. However, the print apparatus may be, for example, a print apparatus such as a printer that does not have the reading function. In the present exemplary embodiment, the print apparatus is assumed to include various kinds of configuration requirements that will be described below, as one example thereof.

A control unit 110, which includes a central processing unit (CPU) 111, controls an operation of the entire MFP 101. The CPU 111 reads out a control program stored in a read only memory (ROM) 112 or a storage 114, and performs various kinds of control, such as reading control and print control. The ROM 112 stores the control program executable by the CPU 111. Further, the ROM 112 stores a boot sequence, font information, and the like. A random access memory (RAM) 113 is a main storage memory of the CPU 111, and is used as a temporary storage area for developing various kinds of control programs stored in a work area, the ROM 112, and the storage 114. The storage 114 stores image data, print data, various kinds of programs, and various kinds of setting information. In the present exemplary embodiment, an auxiliary storage device such as a hard disk drive (HDD) is assumed to be used as the storage 114, but the MFP 101 may be configured to use a flash disk represented by a solid state drive (SSD) instead of the HDD.

The MFP 101 according to the present exemplary embodiment is assumed to be configured in such a manner that the single CPU 111 performs, with use of the single memory (the RAM 113), respective processing procedures illustrated in flowcharts that will be described below, but may be configured in another manner. For example, the MFP 101 can also be configured in such a manner that a plurality of CPUs, a plurality of RAMS, a plurality of ROMs, and a plurality of storages cooperate to perform the respective processing procedures illustrated in the flowcharts that will be described below. Further, the MFP 101 may be configured to perform a part of the processing procedures with use of a hardware circuit such as an application specific integrated circuit (ASIC) and a field-programmable gate array (FPGA).

Figure 2:
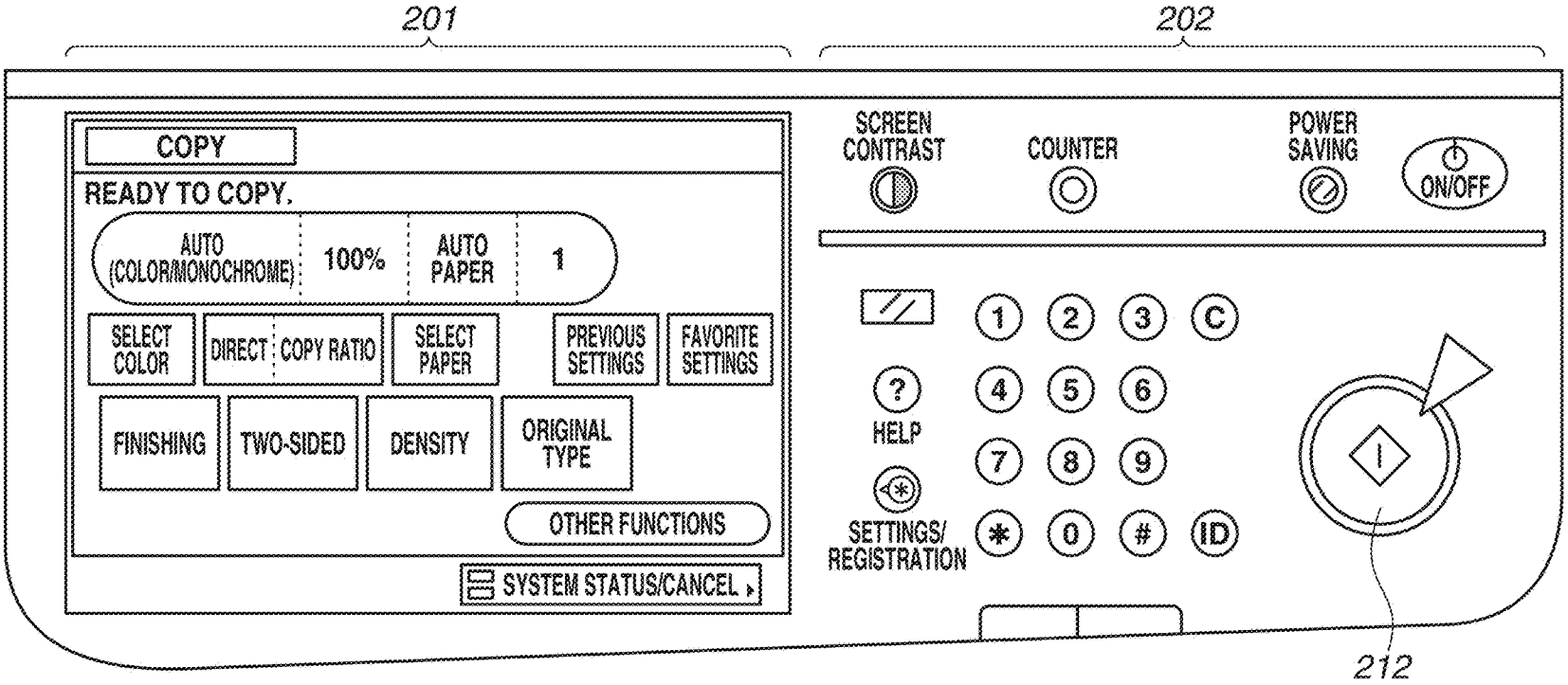
FIG. 2 illustrates an operation unit.

An operation unit interface (I/F) 115 connects an operation unit 116 and the control unit 110 to each other. The operation unit 116 displays information to the user, and inputs an instruction from the user. FIG. 2 illustrates an outer appearance of the operation unit 116. The operation unit 116 includes a panel 201, which displays operation screens that will be described below, and a hardware key input unit 202. The panel 201 is, for example, a touch panel display. The hardware key input unit 202 includes various kinds of hardware keys, such as a start button 212. The user inputs an instruction by touching a key displayed on the panel 201, or pressing the various kinds of hardware keys of the hardware key input unit 202. The panel 201 may be a display that does not have the touch panel function. In this case, the operation unit 116 can serve an intended role sufficiently by including, as the hardware key input unit 202, a scroll key for selecting a key displayed on the display and an enter/OK key for determining the selection of this key, which substitute for the key input by a touch operation. The operation unit 116 receives the instruction issued from the user via the panel 201 and the input unit 202, and displays the operation screen on the panel 201 as necessary.

A reading unit I/F 117 connects a reading unit 118 and the control unit 110 to each other. The reading unit 118 reads an image on a sheet, and converts this image into image data such as binary data. The image data generated by the reading unit 118 is transferred to a compression/decompression unit 124 via the reading unit I/F 117. The image data compressed by the compression/decompression unit 124 is stored into the storage 114 or the RAM 113 of the control unit 110. The stored image data is transmitted to an external apparatus via a communication unit I/F 123, or is printed onto a sheet.

A print unit I/F 119 connects a print unit 120 and the control unit 110 to each other. The image data that should be printed (the image data set as a print target) is transferred from the control unit 110 to the print unit 120 via the print unit I/F 119. The print unit 120 receives a control command and the image data that should be printed via the control unit 110, and prints an image based on this image data onto a sheet.

A sheet processing unit I/F 121 connects a sheet processing unit 122 and the control unit 110 to each other. The sheet processing unit 122 receives the control command via the control unit 110, and performs post-processing on the sheet with the image printed thereon by the print unit 120 according to this control command. For example, the sheet processing unit 122 performs the post-processing such as aligning the plurality of sheets with one another, and binding the plurality of sheets together. Further, the control unit 110 is notified of a function of the post-processing and a capability of the post-processing that the sheet processing unit 122 has via the sheet processing unit I/F 121 in advance (for example, when the MFP 101 starts up), and then the storage 114 or the RAM 113 is notified of this information. In the present exemplary embodiment, the sheet processing unit 122 can perform at least binding processing for binding a plurality of sheets together with use of a staple, and binding processing for binding a plurality of sheets together without use of a staple.

The control unit 110 is connected to the network 100 via the communication unit I/F 123. The communication unit I/F 123 transmits image data and information to an external apparatus in the network 100, and receives print data and information from an external apparatus such as the information processing apparatus in the network 100. Further, the communication unit I/F 123 communicates with an external apparatus via a local interface, such as Universal Serial Bus (USB). The print data received by the communication unit I/F 123 is stored into the storage 114.

The print data received via the communication unit I/F 123 is analyzed by a software module (a page description language (PDL) analysis unit, not illustrated) provided for analyzing the print data stored in the storage 114 or the ROM 112. The PDL analysis unit analyzes the print data expressed in various kinds of page description languages (PDLs) stored in the storage 114. The print data includes a code regarding print attributes, and a code regarding rendering. Print attribute information, such as the number of copies, information regarding the binding processing, and a sheet size, a sheet type, and a sheet feed stage at the time of an output, is set to the print data for each of the entire print data or a part of pages in the print data.

The PDL analysis unit temporarily stores, into the RAM 113 or the storage 114, settings regarding the print attributes (the print attribute information) that are acquired from the analysis of the print data. Further, the PDL analysis unit analyzes a rendering code contained in the print data to convert this code into an intermediate code. This intermediate code is data in a format more suitable to rendering processing (rasterizing processing) compared to the print data itself, and mainly includes coordinates of edges, edge-to-edge filling data, and the like.

Further, the PDL analysis unit, for example, calculates the number of sheets to be output from a result of the analysis of the PDL, and stores the calculated data into the RAM 113 or the storage 114 as the print attribute information. The print attribute information acquired or calculated by the PDL analysis unit is referred to as necessary during execution of the print processing based on the print data and the post-processing by the sheet processing unit 122.

The intermediate code generated by the PDL analysis unit is converted into image data by a raster image processor (RIP) 125. The RIP 125 performs the rendering processing on the intermediate code generated by the PDL analysis unit, and generates image data to be printed by the print unit 120. The image data generated by the RIP 125 is printed by the print unit 120 based on the print settings.

Figure 3:
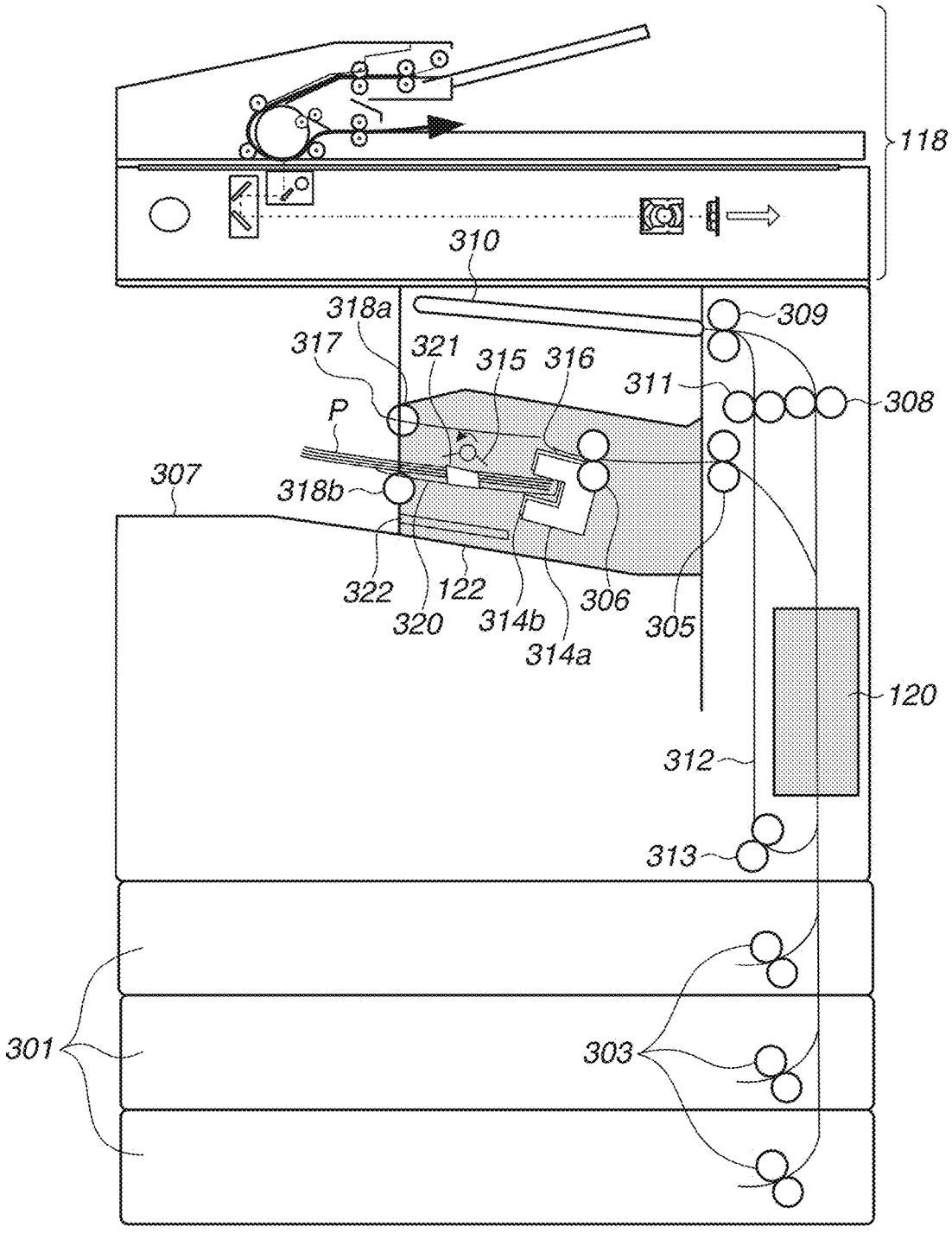
FIG. 3 is a cross-sectional view of a multifunction peripheral (MFP).

The print processing and the post-processing performed on the sheet(s) will be described. FIG. 3 is a cross-sectional view of the MFP 101. In FIG. 3, the sheet processing unit 122 is disposed inside a housing of the MFP 101. However, where the sheet processing unit 122 is disposed is not limited to the example illustrated in FIG. 3. For example, the sheet processing unit 122 may be connected so as to be located adjacent to the MFP 101. Further, for example, the MFP 101 itself may have an apparatus configuration including the sheet processing unit 122 as standard equipment, like the present exemplary embodiment, or may have an apparatus configuration to which the sheet processing unit 122 is connected as optional equipment.

Sheet feed units 301 contain sheets. In FIG. 3, the MFP 101 includes three sheet feed units 301, but the number of sheet feed units 301 is not limited to three. Sheet feed rollers 303 each feed and convey the sheet contained in the sheet feed unit 301 to the print unit 120. The print unit 120 prints an image onto a first side of the fed and conveyed sheet. The print unit 120 may employ an inkjet method that prints an image by discharging ink onto the sheet, or may employ an electrophotographic method that prints an image by fixing toner onto the sheet.

In the case of the one-sided printing, the sheet with the image printed thereon is guided by conveyance rollers 305 and 306 to be conveyed to the sheet processing unit 122, and is discharged onto an intermediate tray 320. In this case, the sheet is discharged in such a state that a back side of the printed side is visible when the output sheet is viewed from above the apparatus (a state that the sheet is laid with its front side down). Such a discharge orientation will be referred to as a face-down orientation.

In the present exemplary embodiment, normally, the MFP 101 performs the normal order printing, which prints a plurality of pages sequentially, starting from a first page among them. In this case, the sheets are discharged in the face-down orientation so that an output order of a printout matches an original order of the plurality of pages. A sheet of the first page is discharged onto the intermediate tray 320, and then the subsequent pages are discharged after that, by which the sheets are being stacked in a normal order.

In the case of two-sided printing, the sheet with the image printed on the first side thereof by the print unit 120 is guided by a conveyance roller 308, and the conveyance roller 308 conveys the sheet to a conveyance roller 309. The conveyance roller 309 conveys the sheet to a reversing path 310. When a trailing edge of the sheet reaches the conveyance roller 309, the conveyance roller 309 starts rotating in a reverse direction to convey the sheet to a conveyance roller 311. The conveyance roller 311 conveys the sheet to a conveyance roller 313 via a two-sided printing conveyance path 312. The conveyance roller 313 conveys the sheet to the print unit 120. The print unit 120 prints an image onto a second side of the sheet. The sheet with the images printed on the both sides thereof is guided by the conveyance rollers 305 and 306, and is discharged onto the intermediate tray 320. In this case, the sheet is discharged in such a state that the printed side is visible when the output sheet is viewed from above the apparatus (a state that the sheet is laid with its front side up). Such a discharge orientation will be referred to as a face-up orientation.

In the present exemplary embodiment, when the MFP 101 performs the reverse order printing, which prints the plurality of pages in a reverse order, starting from a last page among them, the sheets are discharged in the face-up orientation so that the output order of the printout matches the original order of the plurality of pages. A sheet of the last page is discharged onto the intermediate tray 320, and the subsequent pages are output in the reverse order after that, by which the sheets are being stacked in the reverse order.

In the case of the two-sided printing, a printing order of images (a descending order or an ascending order) can be arbitrarily changed. Therefore, even when the MFP 101 performs the two-sided printing, the MFP 101 can discharge the sheets in the face-down orientation and perform the normal order printing by controlling an operation so as to print an image corresponding to a second page onto the first side, and then reversing the sheet to print an image corresponding to the first page onto the second side.

Even in the case of the one-sided printing, the MFP 101 can also perform the reverse order printing by discharging the sheets in the face-up orientation via the reversing path 310. In this case, the MFP 101 prints an image onto the first side of the fed and conveyed sheet, and then conveys this sheet to the reversing path 310 in a similar manner to the operation at the time of the two-sided printing. The sheet reversed in the reversing path 310 is conveyed to the sheet processing unit 122 without any image printed onto the second side by the print unit 120, and then is discharged onto the intermediate tray 320.

The intermediate tray 320 is inclined by being arranged in such a manner that a downstream side (a left side in FIG. 3) and an upstream side (a right side in FIG. 3) thereof in a sheet conveyance direction are located on a vertically upper side and a vertically lower side, respectively, and can hold a plurality of sheets. Further, the intermediate tray 320 includes a bundle discharge roller pair 318 including a pair of upper and lower bundle discharge rollers 318*a* and 318*b* disposed on the downstream side, and a pull-in puddle 315 disposed above an intermediate portion. The upper bundle discharge roller 318*a* is supported by a guide 317.

This guide 317 is configured to be vertically displaceable by a motor (not illustrated). Accordingly, the upper bundle discharge roller 318*a* disposed on the guide 317 is enabled to separate from and contact the lower bundle discharge roller 318*b* according to the vertical displacement of the guide 317. Therefore, a distance between these rollers 318*a* and 318*b* of the bundle discharge roller pair 318 is allowed to be adjusted according to a thickness of a sheet bundle held on the intermediate tray 320.

The CPU 111 receives a sheet P discharged by the conveyance roller 306 onto the intermediate tray 320 with the guide 317 displaced to the upper side so that the lower bundle discharge roller 318*b* is brought into a state separated from the upper bundle discharger roller 318*a*.

Alignment members 321 are provided on a front side and a back side on the intermediate tray 320 in a width direction perpendicular to the sheet conveyance direction. The alignment members 321 are displaceable in a width direction by a front alignment motor (not illustrated) and a back alignment motor (not illustrated), respectively. The terms "front" and "back" herein refer to a portion located at a front and a portion located at a back of paper of FIG. 3 when the MFP 101 is viewed from a direction as illustrated in FIG. 3, respectively. The pull-in puddle 315 rotates around a rotational axis in a direction pushing the sheet P toward a stopper 316 side (for example, a counterclockwise direction in FIG. 3).

The sheet P guided by the conveyance roller 306 and discharged onto the intermediate tray 320 slides down on a stack surface of the intermediate tray 320 or on a top of the sheets stacked on the intermediate tray 320 with the aid of the inclination of the intermediate tray 320 and an operation of pushing the sheet P by the pull-in puddle 315. The sheet P discharged onto the intermediate tray 320 is subject to alignment processing by the alignment members 321 while sliding down, and stops by abutment of a trailing edge (an upstream end in a discharge direction) of the sheet P against the stopper 316.

The sheet bundle aligned on the intermediate tray 320 is subject to the binding processing by a staple use binding unit 314*a* or a staple non-use binding unit 314*b* as necessary. The binding units 314*a* and 314*b* can bind the sheet bundle held on the intermediate tray 320 on a trailing edge portion thereof in the conveyance direction. In the present exemplary embodiment, the binding units 314*a* and 314*b* are configured to bind the sheet bundle on the trailing edge portion thereof in the conveyance direction, but are not limited thereto. For example, the binding units 314*a* and 314*b* may be configured to bind the sheet bundle held on the intermediate tray 320 on a leading edge portion thereof in the conveyance direction.

The sheet bundle processed by the post-processing such as the binding processing by the sheet processing unit 122 is discharged onto a discharge unit 307. More specifically, the guide 317 is displaced so as to lower the bundle discharge roller 318*a* into abutment with an uppermost sheet on the intermediate tray 320, and the bundle discharge roller pair 318 is rotationally driven in this abutment state, by which the sheet bundle already processed by the post-processing is discharged onto the discharge unit 307.

Figure 4:
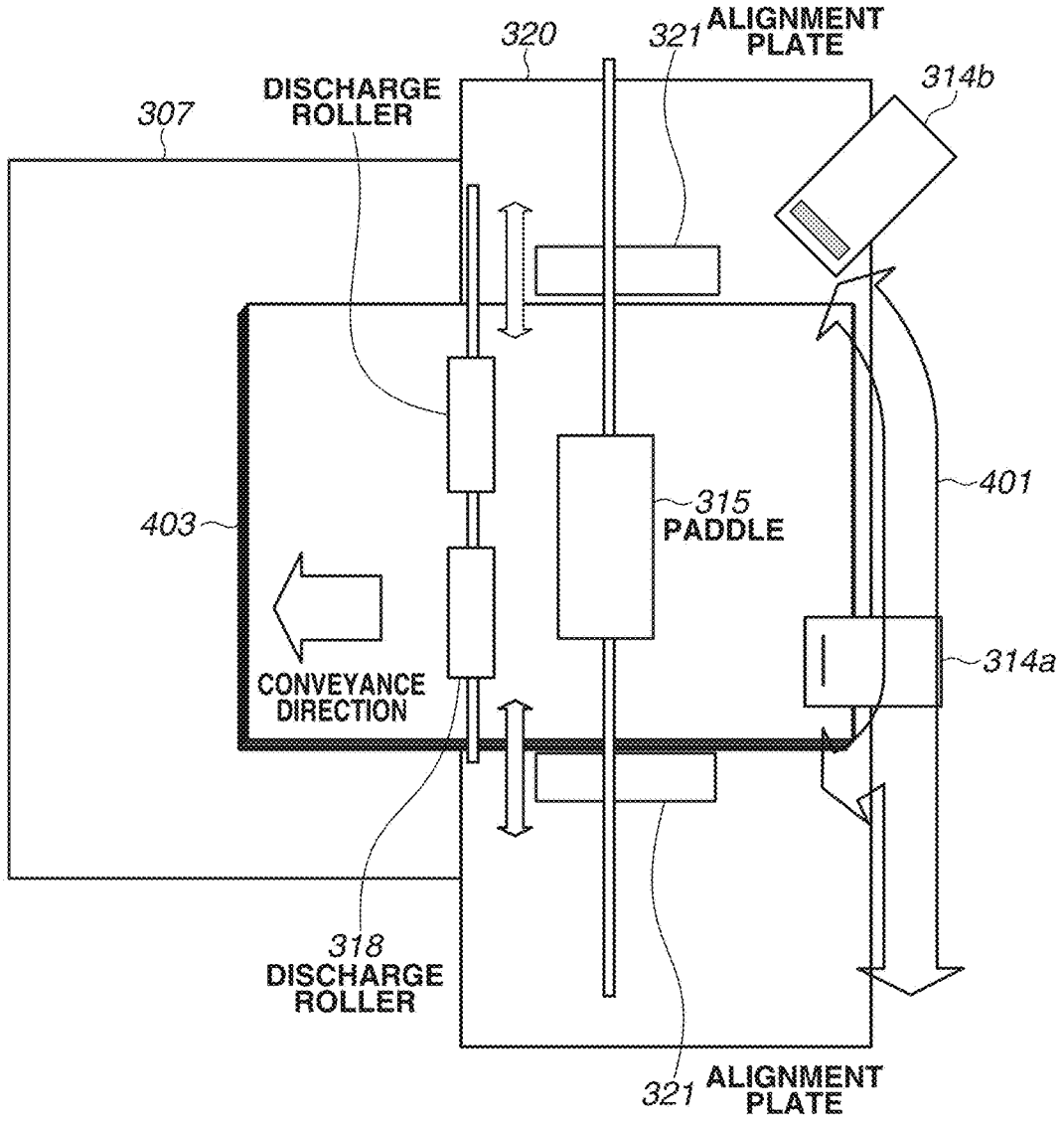
FIG. 4 is a cross-sectional view illustrating a sheet processing unit as viewed from above.

FIG. 4 is a cross-sectional view illustrating the sheet processing unit 122 as viewed from above, and illustrates a position where the binding unit 314*a* or 314*b* performs the binding processing. A plurality of sheets 403 is placed on the intermediate tray 320. The sheet processing unit 122 can bind the plurality of sheets 403 according to the information regarding the binding processing that is received from the control unit 110. The staple use binding unit 314*a* is configured to be slidable by a not-illustrated motor in a direction indicated by an arrow 401 illustrated in FIG. 4. The CPU 111 drives the not-illustrated motor to displace the staple use binding unit 314*a* in the direction perpendicular to the conveyance direction, thereby binding the sheet bundle 403 at a corner on the trailing edge portion thereof in the conveyance direction or binding the sheet bundle 403 at two portions on the trailing edge thereof. Therefore, the sheet bundle 403 can be bound at two portions on a side perpendicular as viewed from the conveyance direction with the aid of the displacement of the binding unit 314*a* and a vertical reversal (a rotation by 180 degrees) of the images to be printed thereon. Further, similarly, the sheet bundle 403 can be bound at any one corner among four corners (upper left, upper right, lower right, and lower left corners) of the sheets 403.

The staple use binding unit 314*a* performs the binding processing by driving a staple for stapling (not illustrated) through the sheet bundle 403 (hereinafter referred to as staple binding). The staple use binding unit 314*a* stores a cartridge (not illustrated) in which staples for stapling are loaded. The user can reload the staples by replacing the cartridge.

On the other hand, the staple non-use binding unit 314*b* is fixed at a position on the back side as viewed from the front face of the MFP 101. Therefore, the following processing is performed, when the sheet bundle 403 is bound with use of the staple non-use binding unit 314*b*. The CPU 111 slides the alignment members 321 in a direction toward the "back" where the staple non-use binding unit 314*b* is located. Further, the CPU 111 controls an operation so as to discharge the sheet bundle 403 with the images printed thereon onto the back side of the intermediate tray 320. The staple non-use binding unit 314*b* binds the sheet bundle 403 aligned by the alignment members 321 at one position on the back side of the trailing edge portion thereof.

Figure 5A:
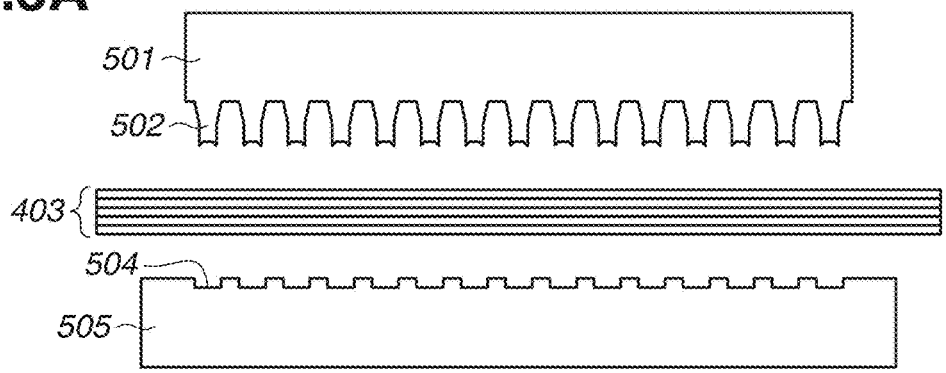
FIGS. 5A, 5B, and 5C illustrate binding processing performed by a staple non-use binding unit.
Figure 5B:
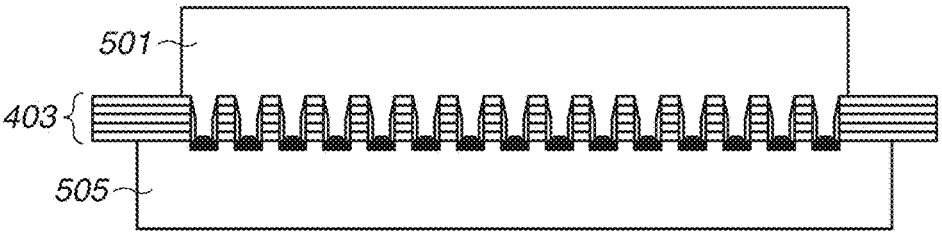
Figure 5C:
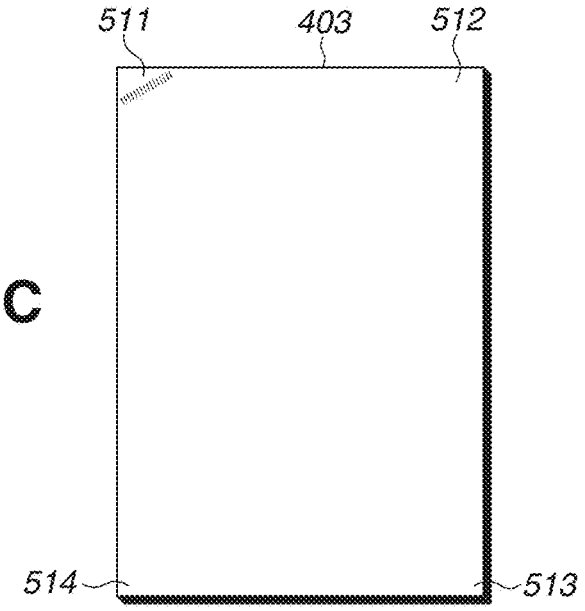

FIGS. 5A, 5B, and 5C illustrate the binding processing performed by the staple non-use binding unit 314*b*. The staple non-use binding unit 314*b* according to the present exemplary embodiment binds the sheet bundle 403 by applying a pressure to the plurality of sheets 403 from above and below to press the sheets 403 into close contact with one another. FIG. 5A illustrates a vicinity of a position where the staple non-use binding unit 314*b* performs the binding processing on the sheet bundle 403. An upper die 501 presses the plurality of sheets 403 from above. A plurality of blades 502 having protruding shapes is lined up on the upper die 501, and each of the blades 502 applies the pressure to the sheets 403. A lower die 505 presses the plurality of sheets 403 from below. A plurality of recesses 504 corresponding to the plurality of blades 502 is lined up on the lower die 505, and each of the recesses 504 receives each of the blades 502.

FIG. 5B illustrates the staple non-use binding unit 314*b* with the upper die 501 and the lower die 505 pressing the plurality of sheets 403 from a vertical direction. The upper die 501 and the lower die 505 press the plurality of sheets 403, thereby allowing fibers between the sheets 403 to tangle with each other to bind the sheets 403. Further, the plurality of blades 502 and the plurality of recesses 504 press a plurality of portions of the sheets 403, thereby preventing the sheets 403 from easily separating from one another.

FIG. 5C illustrates one example of the sheet bundle 403 bound at the upper left corner by the binding processing using no staple. As illustrated in FIG. 5C, the sheets 403 stapled without use of a staple are bound together by being partially crushed into pressure contact with one another. Positions 511 to 514 indicate positions where the staple non-use binding unit 314*b* can bind the sheet bundle 403. The position 511 and the position 512 indicate the upper left corner and the upper right corner of the sheet bundle 403, respectively. Further, the position 513 and the position 514 indicate the lower right corner and the lower left corner of the sheet bundle 403, respectively.

Figure 6:
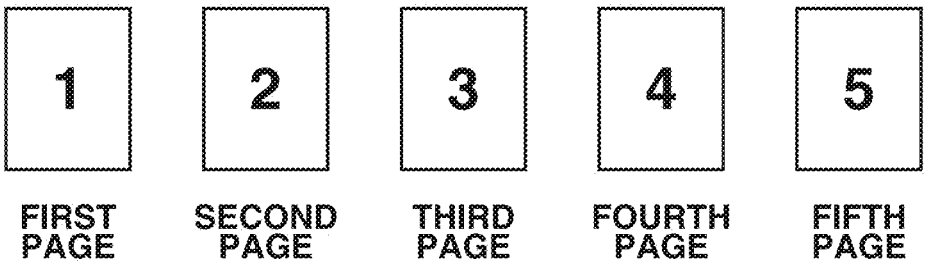
FIG. 6 illustrates one example of image data to be printed.

FIG. 6 illustrates one example of image data to be printed by the print unit 120. In the present exemplary embodiment, a sequential order of image data pieces, and numerical values illustrated on these image data pieces are expressed so as to match each other for convenience of the following description.

Figure 7:
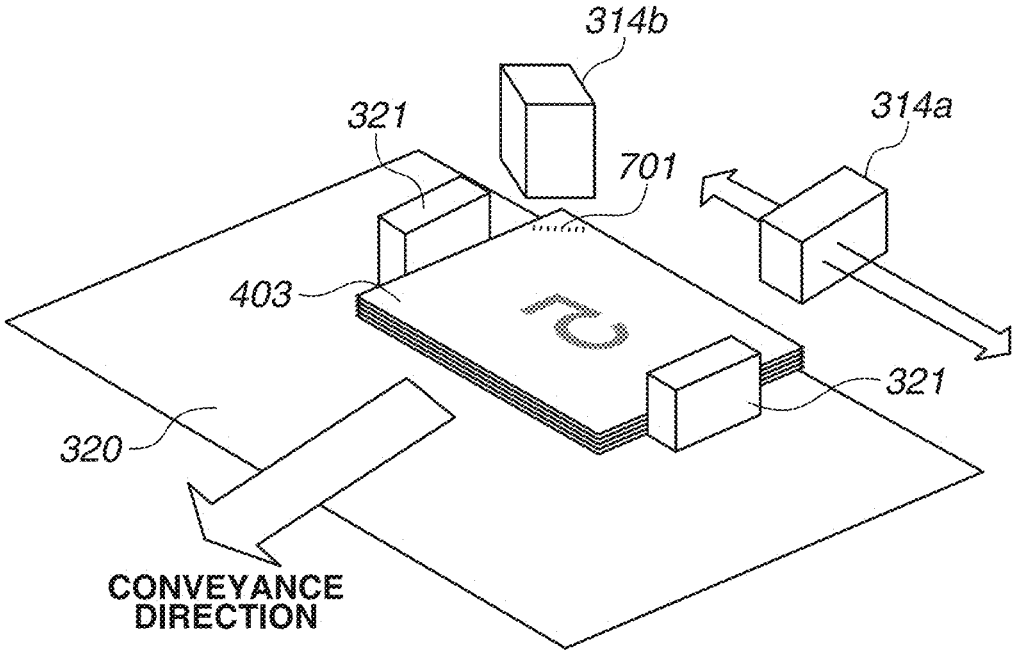
FIG. 7 illustrates the binding processing performed by the staple non-use binding unit.

FIG. 7 illustrates the binding processing performed by the staple non-use binding unit 314*b*. FIG. 7 illustrates the sheet processing unit 122 with the sheet bundle 403 bound after the image data illustrated in FIG. 6 has been printed onto the sheet bundle 403 by the one-side printing, and the sheet bundle 403 is discharged onto the intermediate tray 320 in the face-down orientation. When binding the sheets 403 by the staple non-use binding unit 314*b*, the CPU 111 slides the alignment members 321 in the direction toward the "back" where the staple non-use binding unit 314*b* is located. The sheets 403 with the images printed thereon by the print unit 120 are sequentially discharged onto the intermediate tray 320 in the face-down orientation, and stacked on the intermediate tray 320. A position 701 indicates a position where the staple non-use binding unit 314*b* is to perform the binding processing. The sheet bundle 403 processed by the post-processing on the intermediate tray 320 is discharged onto the discharge unit 307.

In the present exemplary embodiment, when the sheet bundle 403 is bound by the staple non-use binding unit 314*b* configured to perform the binding processing only at the fixed single position, the binding processing at the four corners (the upper right, upper left, lower left, and lower right corners) of a printout is realized by a combination of the rotation of the images to be printed and a printing order.

Figure 8:
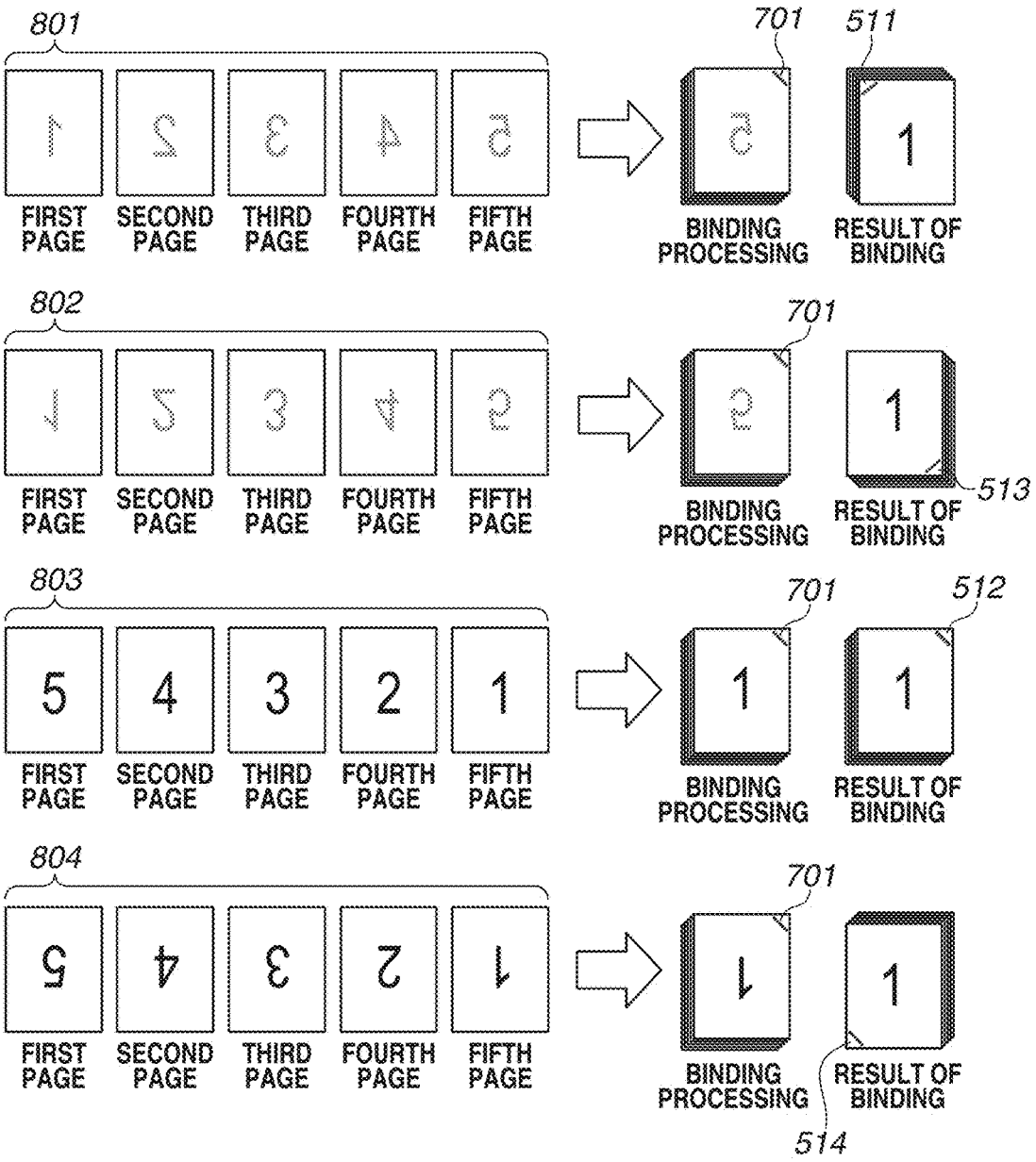
FIG. 8 illustrates a correspondence relationship among print control, the binding processing, and a result of the binding when a sheet bundle is bound by the staple non-use binding unit.

FIG. 8 illustrates a correspondence relationship among print control, the binding processing, and a result of the binding when the sheet bundle is bound by the staple non-use binding unit 314*b*. In FIG. 8, "1", "2", "3", "4", and "5" indicate the printed images, and orientations of the numbers express orientations of the images printed on the sheets. Numbers illustrated in a dark color express the discharge in the face-up orientation, and numbers illustrated in a light color express the discharge in the face-down orientation.

If the printout is bound at the upper left corner, the images are printed in the normal order without their orientations rotated, as indicated by images 801. After a fifth sheet is discharged, the binding processing is performed at the position 701 by the staple non-use binding unit 314*b*. In this case, the binding processing results in the printout bound at the upper left corner (the position 511).

If the printout is bound at the lower right corner, the images are printed in the normal order with their orientations rotated by 180 degrees (vertically reversed), as indicated by images 802. After the fifth sheet is discharged, the binding processing is performed at the position 701 by the staple non-use binding unit 314*b*. In this case, the binding processing results in the printout bound at the lower right corner (the position 513). In this manner, the position where the printout is bound can be changed by execution of the print control of rotating the images to be printed, even with the binding unit 314*b* located at the same position when performing the binding processing.

If the printout is bound at the upper right corner, the images are printed in the reverse order without their orientations rotated. First, the image data of the fifth page is printed onto a first sheet. In this case, the first sheet is discharged in the face-up orientation so that the sheet is laid with its printed front side up. As the printing advances, the image data of the first page is printed onto the fifth sheet and this fifth sheet is discharged onto the intermediate tray 320. Then, the binding processing is performed at the position 701 by the staple non-use binding unit 314*b*. In this case, the binding processing results in the printout bound at the upper right corner (the position 512).

If the printout is bound at the lower left corner, the images are printed in the reverse order with their orientations rotated by 180 degrees. After the fifth sheet is discharged, the binding processing is performed at the position 701 by the staple non-use binding unit 314*b*. In this case, the binding processing results in the printout bound at the lower left corner (the position 514).

In this manner, the position where the printout is bound can be changed by execution of the print control as a combination of the rotation of the images and the reverse order printing, even with the binding unit 314*b* located at the same position when performing the binding processing.

In the present exemplary embodiment, the staple use binding unit 314*a* has been indicated, by way of example, as the binding unit capable of performing the binding processing at the plurality of positions by being displaced, and the staple non-use binding unit 314*b* has been indicated, by way of example, as the binding unit configured to perform the binding processing at the fixed single position. However, the binding units are not limited thereto. The present exemplary embodiment can be applied to any print apparatus as long as the print apparatus includes a binding unit capable of performing the binding processing at a plurality of positions by being displaced, and a binding unit configured to perform the binding processing at a fixed single position, which are mixed together in the print apparatus.

As described so far, the binding unit 314*a*, which is capable of performing the binding processing at the plurality of positions by being displaced, and the binding unit 314*b*, which is configured to perform the binding processing at the fixed single position, require execution of the respective different print control procedures to convey the sheet bundle that should be bound to the intermediate tray 320.

More specifically, the binding unit 314*a*, which is capable of performing the binding processing at the plurality of positions by being displaced, can perform the binding processing at each corner or on each side of the printout without requiring the sheets to be reversed in terms of the front sides and the back sides thereof, by the combination of the displacement of the binding unit 314*a* and the rotation of the images to be printed, provided that the images are printed as the one-sided printing.

On the other hand, as illustrated in FIG. 8, the binding unit 314*b*, which is configured to perform the binding processing at the fixed single position, may require the sheets to be reversed via the conveyance path provided for reversing the sheets in terms of the front sides and the back sides thereof, and discharged in the face-up orientation, even when the images are printed as the one-sided printing. However, reversing the sheets via the reversing path 310 provided for reversing the sheets in terms of the back sides and the front sides thereof may cause the sheets to be wrinkled and/or bent due to the curvature or the bend of the conveyance path and/or under the influence of the roller, resulting in the reduction in the quality of the printout, depending on the sheet type.

In consideration of these problems, in the present exemplary embodiment, the MFP 101 performs print setting control and print control that prevent the reduction in the quality of the printout according to the specified binding position and the binding unit 314*a* or 314*b* that performs the specified binding processing, and these control procedures will be described now.

When the user starts using the MFP 101, a home screen (not illustrated) for selecting processing to be performed is displayed. The user can select a function included in the MFP 101, such as a copy function and a transmission function, via the operation unit 116.

Figure 9A:
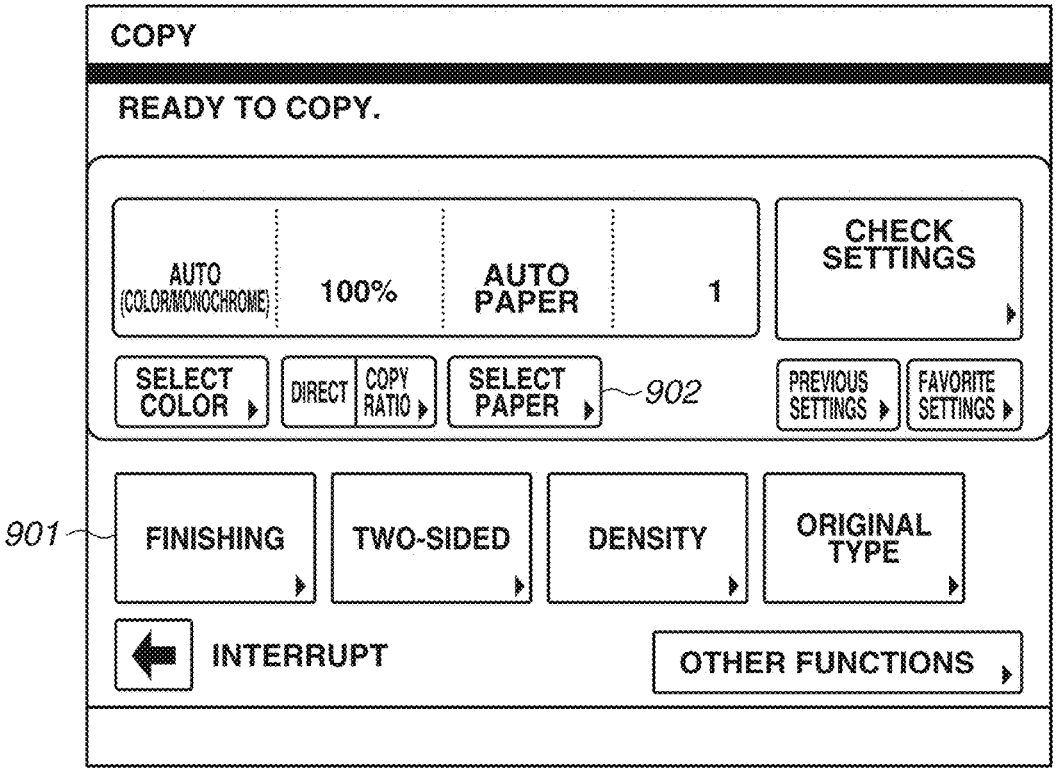
FIGS. 9A and 9B illustrate operation screens displayed on a panel.
Figure 9B:
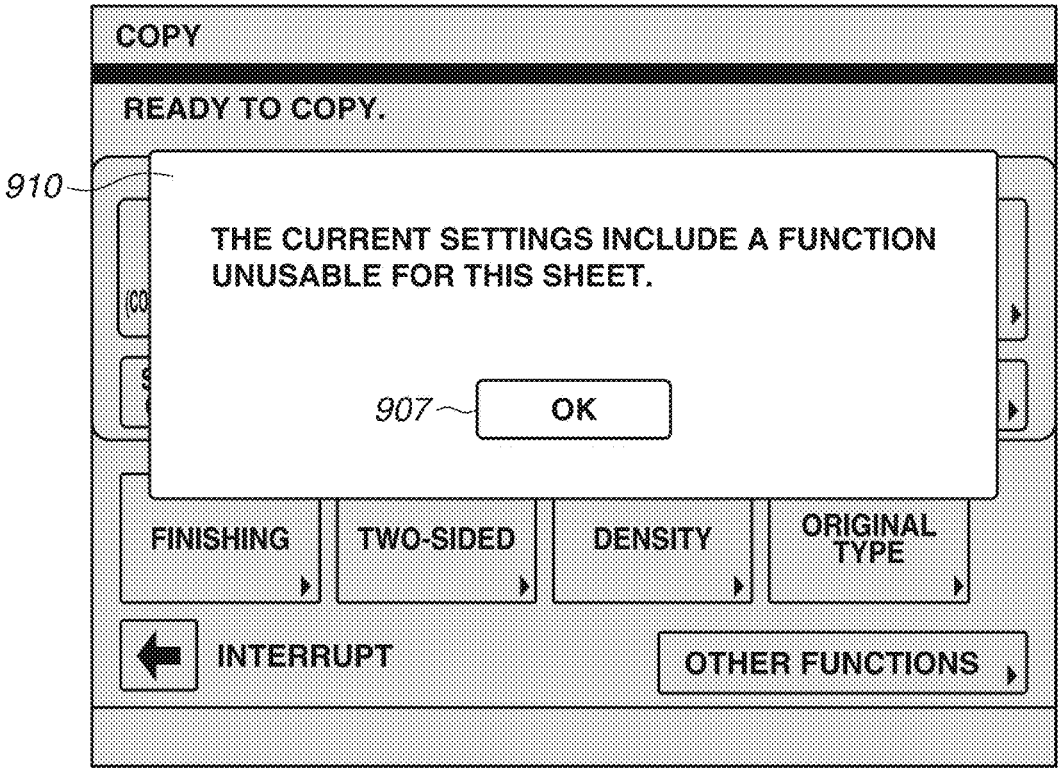

FIGS. 9A and 9B each illustrate one example of an operation screen that the CPU 111 displays on the panel 201 of the operation unit 116. If the user selects the copy function via a home screen (not illustrated), the CPU 111 displays, on the panel 201, a screen for setting a copy job that is illustrated in FIG. 9A.

There are a large number of setting items as the settings of the copy job. Therefore, it is difficult to set the copy job regarding all of the settings on a same single screen. Therefore, the user sets a plurality of functions while the screen transitions to an individual setting screen for each of the setting items.

Figure 10A:
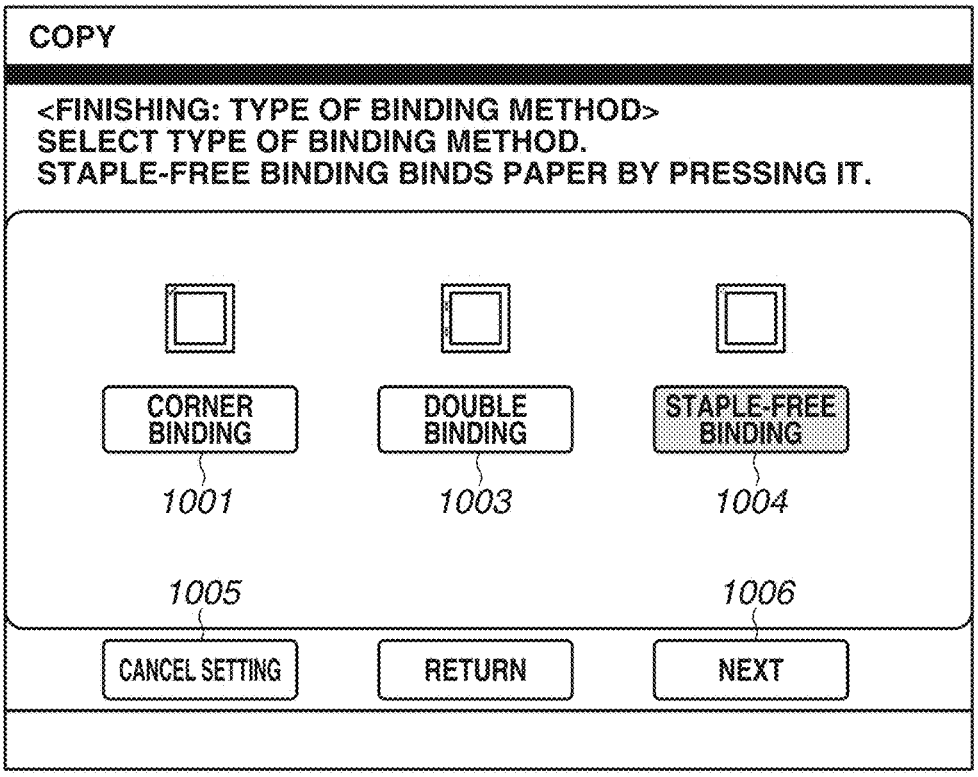
FIGS. 10A and 10B illustrate operation screens displayed on the panel.
Figure 10B:
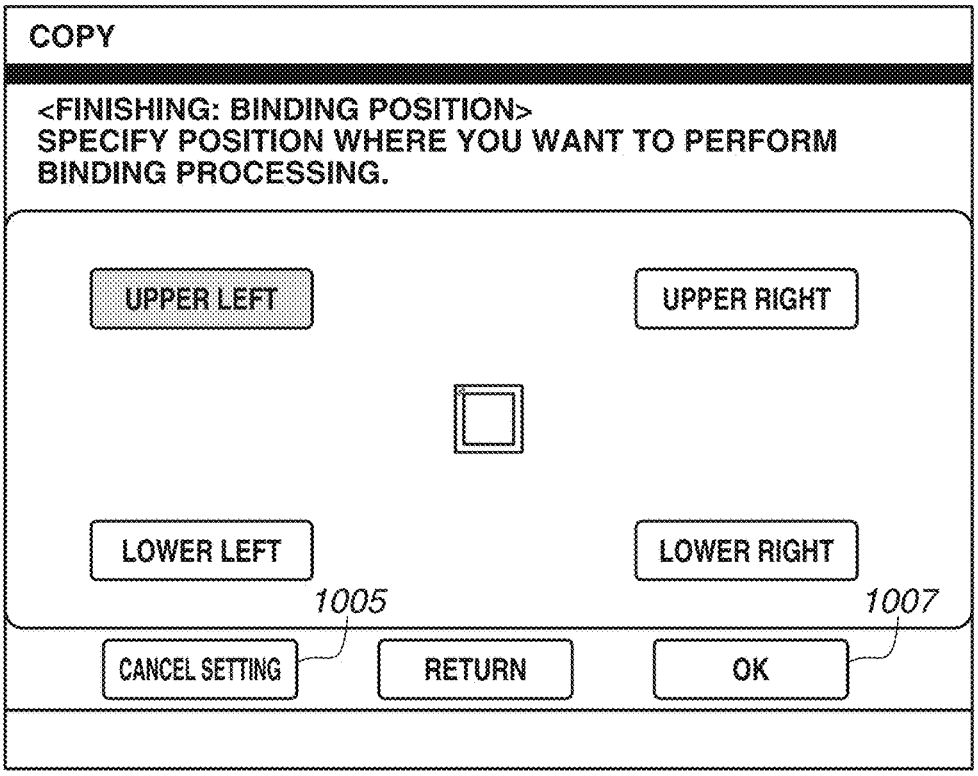

A finishing key 901 is a key that the user uses when setting finishing processing to the copy processing. FIGS. 10A and 10B each illustrate one example of a setting screen regarding the finishing processing. If determining that the finishing key 901 is touched, the CPU 111 displays a screen for setting the finishing processing. FIG. 10A illustrates one example of the screen for setting the finishing processing, and illustrates this screen with a staple-free binding key 1004 selected. A key 1001, a key 1003, and the key 1004 are exclusive settings, and the user can select any one key among them. Further, if none of the keys 1001, 1003, and 1004 is selected, the MFP 101 is set to output the printout without performing the post-processing.

The finishing processing refers to general post processing performed on a printout to be output. In the present exemplary embodiment, a post processing regarding the binding processing is indicated as the finishing processing by way of example. However, the finishing processing is not limited thereto, and the settings regarding the finishing processing may include a setting of another kind of post-processing (for example, a group sort and a shift sort) or the like.

The corner binding key 1001 is a key that the user uses when performing the binding processing at any of the four (upper right, upper left, lower left, and lower right) corners of the printout with use of a staple. Further, the double binding key 1003 is a key that the user uses when performing the binding processing at two positions on any one side of the printout with use of staples. The staple-free binding key 1004 is a key that the user uses when performing the binding processing at any of the four (upper right, upper left, lower left, and lower right) corners of the printout without use of a staple.

A next key 1006 is a key that the user uses when setting the selected finishing processing in detail. If the next key 1006 is touched, the CPU 111 causes the screen to transition to a screen for setting the finishing processing in detail. Further, a cancel setting key 1005 is a key that the user uses when cancelling the settings regarding the finishing processing that are specified via the screens illustrated in FIGS. 10A and 10B. If the cancel setting key 1005 is touched, the CPU 111 cancels the settings regarding the finishing processing, and causes the screen to transition to the screen for setting the copy function (FIG. 9A).

If the next key 1006 is touched with the corner binding key 1001 or the staple-free binding key 1004 selected, the CPU 111 sets the binding position via a screen for selecting any one position among the four corners, like the screen illustrated in FIG. 10B.

FIG. 10B illustrates one example of the screen for setting the finishing processing in detail, which is displayed if the next key 1006 is touched with the corner binding key 1001 or the staple-free binding key 1004 selected, and illustrates this screen with the upper left corner selected. The user specifies the binding position via the screen illustrated in FIG. 10B. Keys corresponding to the upper left, upper right, lower right, and lower left corners are exclusive settings, and the user can select any one key among them.

An OK key 1007 is a key that the user uses when applying the settings of the finishing processing that are selected via the screens illustrated in FIGS. 10A and 10B. If the OK key 1007 is touched, the CPU 111 applies, as the settings of the copy, the settings regarding the binding processing that are specified via the screens illustrated in FIGS. 10A and 10B, and returns to the screen for setting the copy (FIG. 9A).

In the present exemplary embodiment, setting the finishing processing has been described assuming that the setting items are divided across the screen illustrated in FIG. 10A and the screen illustrated in FIG. 10B, and the finishing processing is set on these screens, by way of example. However, setting the finishing processing is not limited thereto, and the finishing processing may be set in any manner as long as the type of the binding method and the binding position can be specified. For example, the MFP 101 may be configured to display a single screen within which the user selects the type of the binding method and specifies the binding position, or may be configured to display a window for selecting the binding position as a pop-up.

Figure 11:
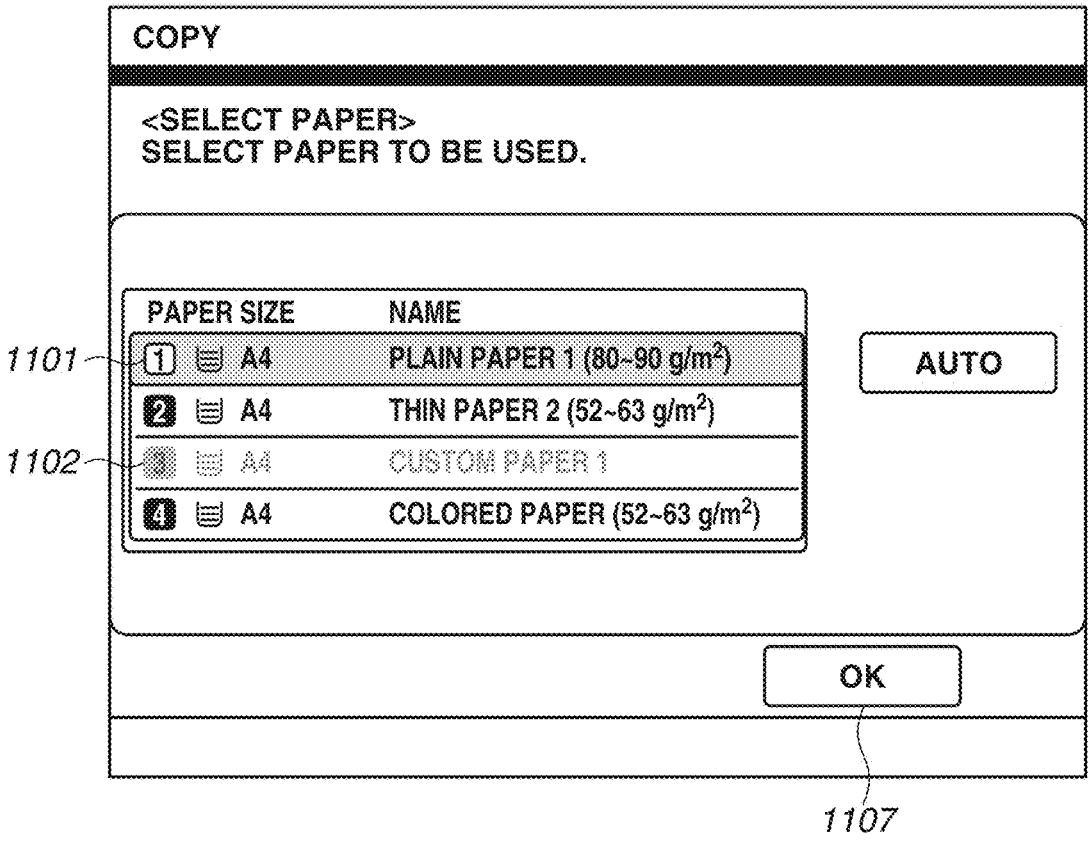
FIG. 11 illustrates an operation screen displayed on the panel.

Returning to the description of FIG. 9A, a paper selection key 902 is a key that the user uses when selecting the sheet type (a paper type) to be used in printing. If the paper selection key 902 is touched, the CPU 111 displays a screen for selecting the sheet. FIG. 11 illustrates one example of an operation screen that the CPU 111 displays on the panel 201 of the operation unit 116, and illustrates one example of the screen for selecting the sheet type. FIG. 11 illustrates this screen with plain paper 1 (80 to 90 g/m$^2$), which is listed in a row 1101, selected, by way of example. The user can select the sheet type to be used in the printing via the screen illustrated in FIG. 11. An OK key 1107 is a key that the user uses when applying the sheet type specified via the screen. If the OK key 1107 is touched, the CPU 111 applies the selected sheet type as the copy setting, and returns to the screen for setting the copy (FIG. 9A). A row 1102 is grayed out, which indicates that this option is in a state not selectable on this screen. The gray-out will be described with reference to a flowchart that will be described below.

Figure 12:
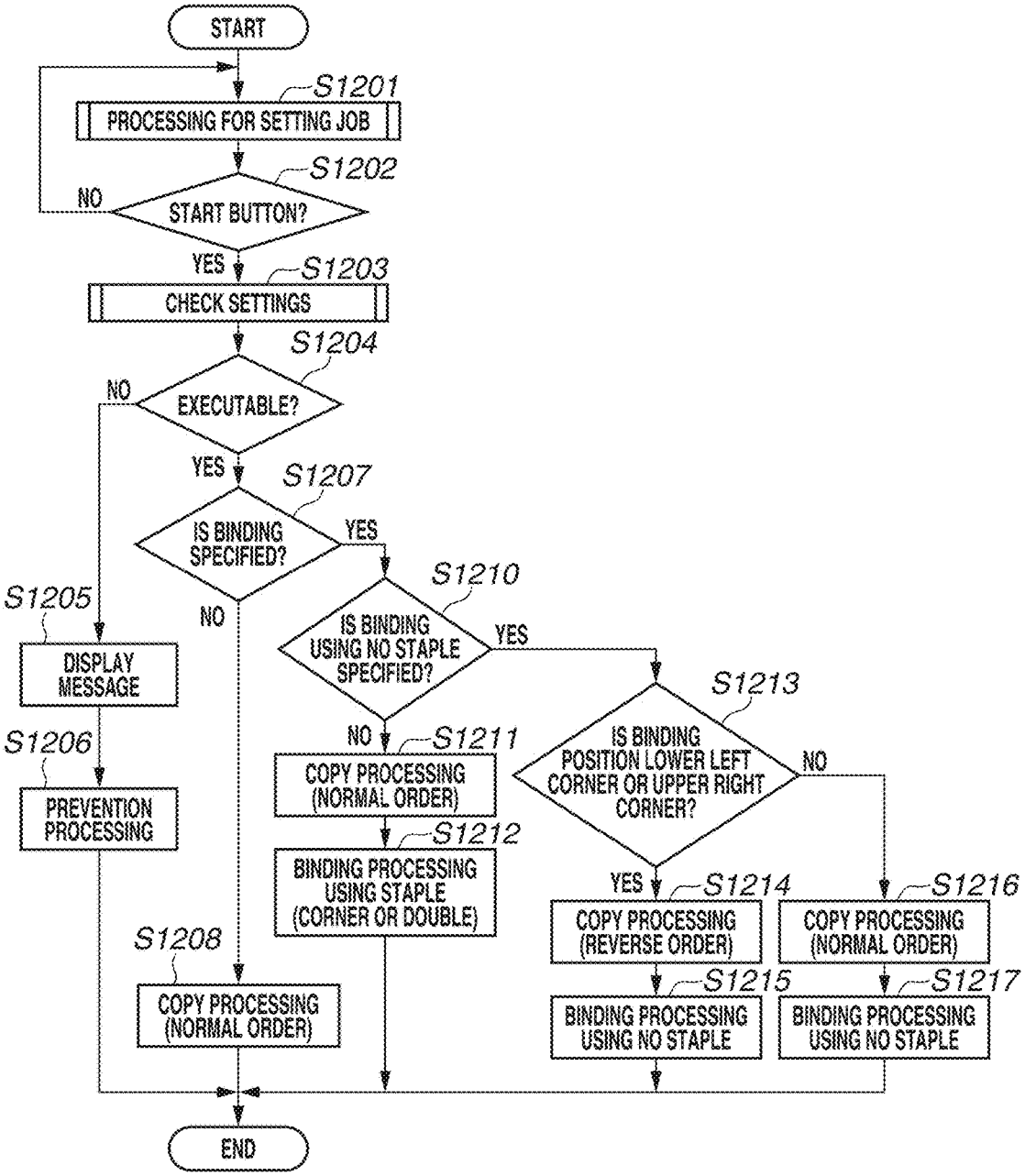
FIG. 12 is a flowchart illustrating a method for controlling print processing.
Figure 13:
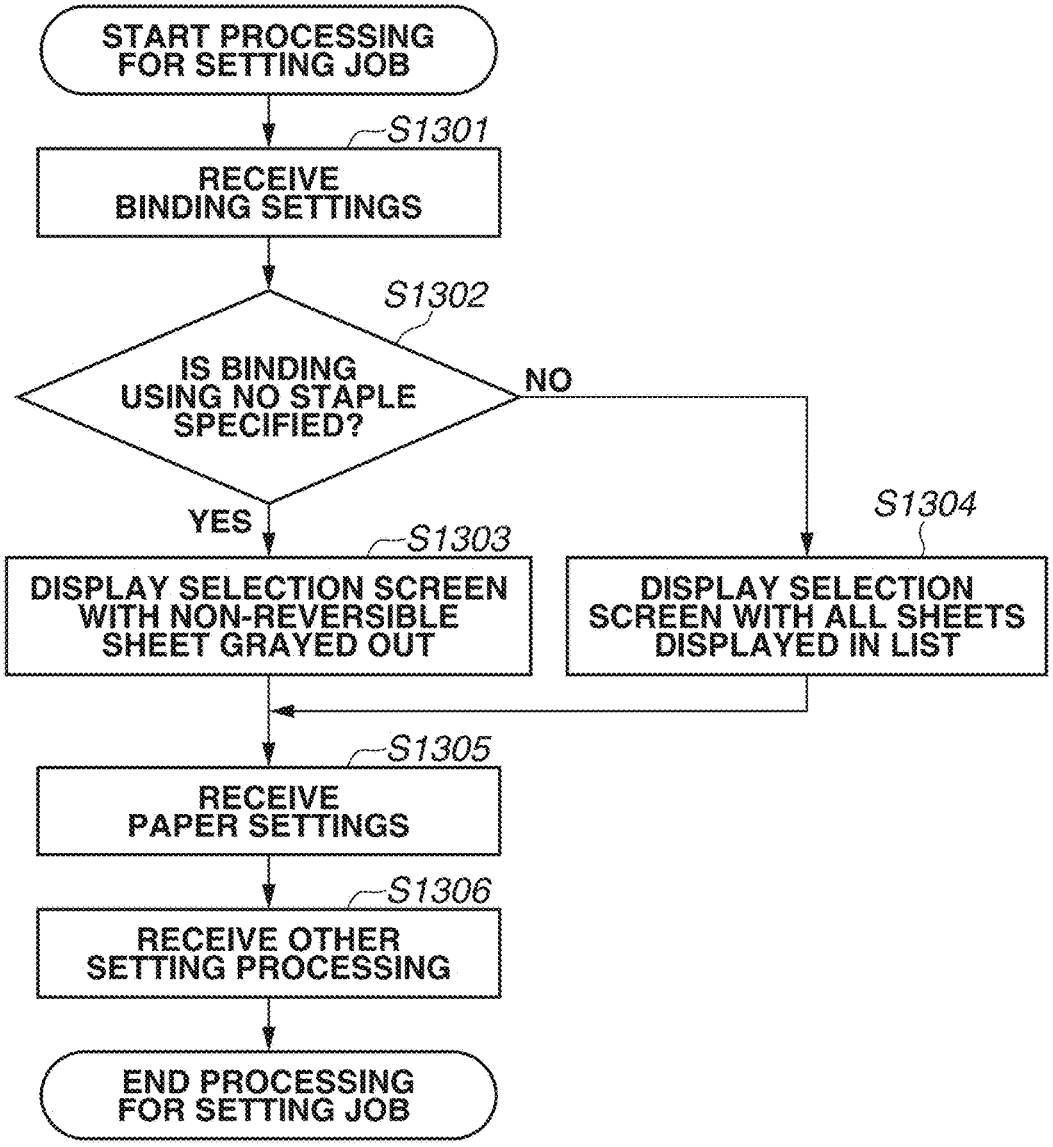
FIG. 13 is a flowchart illustrating the method for controlling the print processing.
Figure 14:
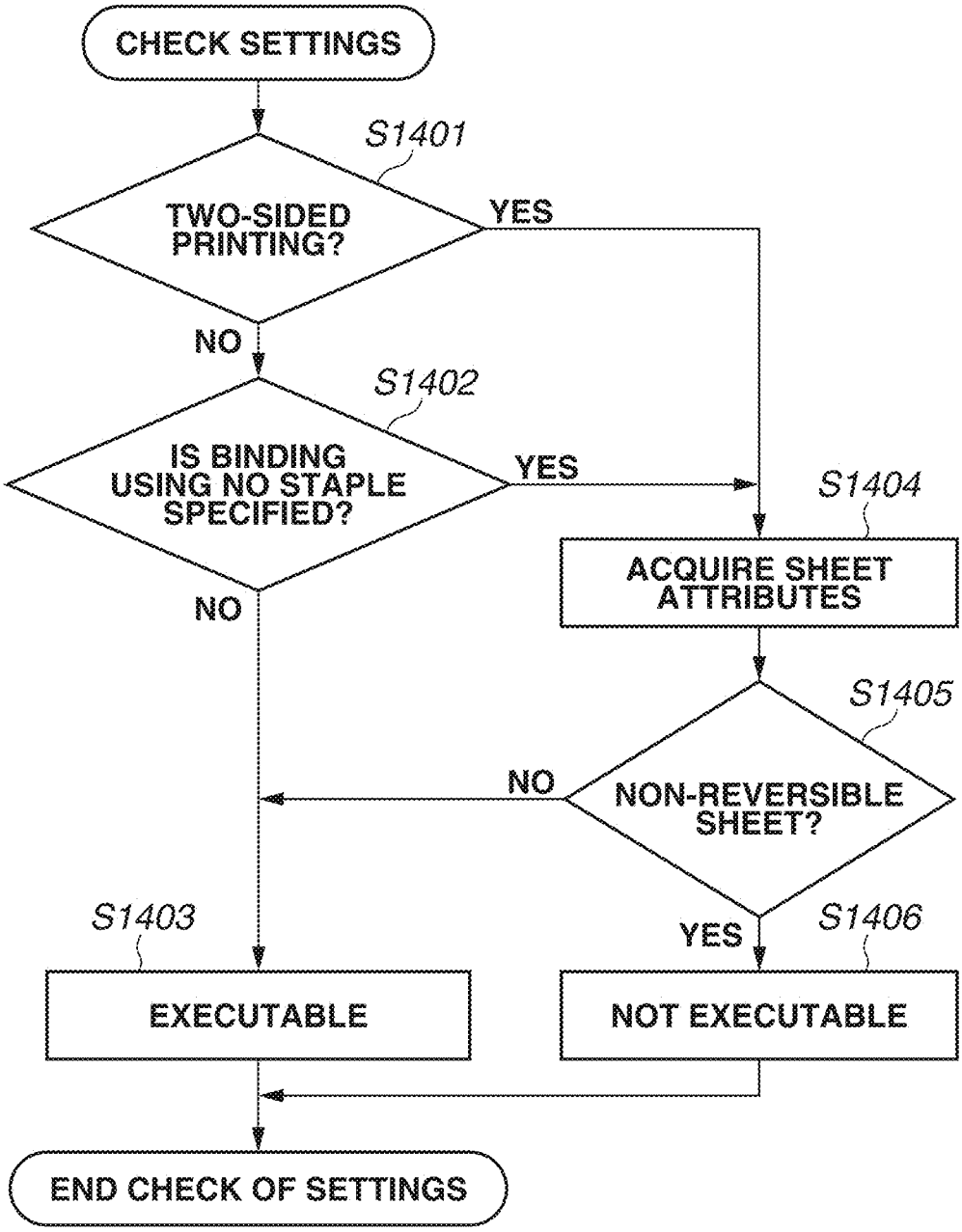
FIG. 14 is a flowchart illustrating the method for controlling the print processing.

Control of the copy processing according to the present exemplary embodiment will be described. FIGS. 12 to 14 are flowcharts illustrating the control of the copy processing. The CPU 111 reads out a control program stored in the ROM 112 or the storage 114 into the RAM 113 to execute the control program, by which each operation (each step) in the flowcharts illustrated in FIGS. 12 to 14 is realized.

When the user selects the copy function via the home screen (not illustrated), the CPU 111 performs the control corresponding to the flowchart of FIG. 12.

In step S1201, the CPU 111 receives settings of a copy job via the panel 201. Details thereof will be described with reference to the flowchart of FIG. 13. If copy job settings through a shift across a plurality of setting operations is performed, the user may bring about a complicated screen transition, such as a transition including a cancel or a change of the setting of the already set item, to reach the desired copy settings. FIG. 13 illustrates control performed when the copy job is set regarding the sheet selection after being set regarding the binding processing, as one example of processing for making settings mutually exclusive with respect to settings that will cause inconvenience when being combined with each other or one another. Exclusion processing will be described now based on this example.

In step S1301, the CPU 111 receives the settings of the binding processing and the binding position via the screens illustrated in FIGS. 10A and 10B. In step S1302, the CPU 111 determines whether the binding processing using no staple is specified for the copy job. If the CPU 111 determines that the binding processing using no staple is specified for the copy job (YES in step S1302), the processing proceeds to step S1303. On the other hand, if the CPU 111 determines that the binding processing using no staple is not specified (the binding processing using a staple is specified or the binding processing is not specified) (NO in step S1302), the processing proceeds to step S1304.

In step S1303, the CPU 111 displays the screen for selecting a sheet type that is configured to prohibit the user from selecting the non-reversible sheet. The CPU 111 acquires, for example, information regarding a size and a type of the sheet set in the sheet feed unit 301. Further, the CPU 111 acquires information such as a grammage and a shape of this sheet based on the acquired information. The CPU 111 then determines whether this sheet is the non-reversible sheet based on the grammage, the shape, and the like of the sheet set in the sheet feed unit 301. The CPU 111 displays the sheet feed unit 301 corresponding to this sheet in a state selectable by the user if determining that this sheet is the reversible sheet, and displays the sheet feed unit 301 corresponding to this sheet in the state not selectable by the user (the gray-out) if determining that this sheet is the non-reversible sheet. In the present exemplary embodiment, this step has been described assuming that the CPU 111 determines whether the sheet is reversible in the reversing path 310 based on the grammage, the shape, and the like of the sheet, by way of example. However, for example, a flag indicating whether the sheet is the reversible sheet may be set in a table in advance as information about the sheet.

FIG. 11 illustrates one example of the screen displayed so as to prohibit the user from selecting the non-reversible sheet, which is displayed in step S1303. Custom paper 1 is one example of the sheet unsuitable to be output in the face-up orientation or used for the two-sided printing, and is displayed in the gray-out manner by the processing in step S1303. Therefore, the MFP 101 is configured not to receive a selection of the non-reversible sheet, if the staple-free binding is specified and the binding processing will be performed by the binding unit 314*b* configured to perform the binding processing at the fixed single position.

Returning to the description of FIG. 13, in step S1304, the CPU 111 displays the screen for selecting the sheet type, on which all sheets including the non-reversible sheet are displayed in a list. In step S1305, the CPU 111 receives the selection of the sheet type that is made via the screen for selecting the sheet type, which has been displayed on the panel 201 in step S1303 or step S1304.

In step S1306, the CPU 111 receives the other setting processing, and then ends the setting processing. The MFP 101 may be configured to filter the sheet types by, based on the type of the binding processing further set to the job, determining whether the sheet is a sheet processable by this binding processing, when displaying the screen for selecting the sheet in step S1303 or S1304.

Returning to the description of FIG. 12, in step S1202, the CPU 111 determines whether the start button 212 is pressed. If the start button 212 is pressed (YES in step S1202), the processing proceeds to step S1203. If the start button 212 is not pressed (NO in step S1202), the processing returns to step S1201. Then, the CPU 111 receives the settings of the copy job from the user.

In step S1203, the CPU 111 checks the settings of the copy job. As described above, if the copy job settings through the shift across the plurality of setting operations is performed, the user may bring about the complicated screen transition, such as the transition including the cancel or the change of the setting of the already set item, to reach the desired copy settings. Further, the situation may be changed due to another cause than the settings specified via the screens. For example, the sheet type usable for the copy may be changed due to a change in the sheet set in the sheet feed unit 301, or a setting about the operation of the MFP 101 may be changed due to a remote operation of the MFP 101 that the user performs with use of a web browser in the PC 102 or the like.

Therefore, the exclusion processing that relies on the permission or the prohibition of the selection of the setting item displayed on the panel 201 may be unable to make all of the settings mutually exclusive with respect to the settings that will cause inconvenience when being combined with each other or one another. Therefore, the MFP 101 is configured to be able to, immediately after the start button 212 is pressed, check compatibility between or among the setting contents set at this stage, and abort the job processing after that if necessary.

Checking the copy job settings will be described with reference to the flowchart of FIG. 14. FIG. 14 is the flowchart illustrating a setting check regarding the settings of the binding processing and the sheet among the checks of the copy job settings. In step S1401, the CPU 111 determines whether the two-sided printing is set. If the two-sided printing is set (YES in step S1401), the processing proceeds to step S1404. If the two-sided printing is not set (NO in step S1401), the processing proceeds to step S1402.

In step S1402, the CPU 111 determines whether the binding using no staple is specified for the job. If the binding using no staple is specified (YES in step S1402), the processing proceeds to step S1404. If the binding using no staple is not specified (the binding using a staple is specified or the binding processing is not specified) (NO in step S1402), the processing proceeds to step S1403. In step S1403, the CPU 111 stores, into the RAM 113, a determination that the printing based on the settings is executable. Then, the processing proceeds to step S1204.

In step S1404, the CPU 111 acquires the sheet type to be used in the printing, which is set to the job. In step S1405, the CPU 111 acquires the grammage, the shape, and the like of the sheet associated with the sheet type acquired in step S1404, and determines whether this sheet is the non-reversible sheet. If the CPU 111 determines that this sheet is the non-reversible sheet (YES in step S1405), the processing proceeds to step S1406. If the CPU 111 determines that this sheet is the reversible sheet (NO in step S1405), the processing proceeds to step S1403. In step S1406, the CPU 111 stores, into the RAM 113, a determination that the printing based on the settings is not executable. Then, the processing proceeds to step S1204.

Besides the setting check regarding the binding processing, checks regarding the other print settings may also be carried out at this timing. For example, the printing can be determined to be not executable, if the printing is impossible based on another condition such as a paper shortage, a toner shortage, or a shortage of the staples for stapling.

Returning to the description of FIG. 12, in step S1204, the CPU 111 determines whether the printing is executable based on a result of the check by step S1203. If the printing is executable (YES in step S1204), the processing proceeds to step S1207. If the printing is not executable (NO in step S1204), the processing proceeds to step S1205.

In step S1205, the CPU 111 displays a predetermined message on the panel 1201. FIG. 9B illustrates one example of the screen displayed on the panel 201. Information 910 is information for notifying the user that the current settings include an unusable function, so that the job cannot be carried out. The MFP 101 may be configured to notify the user of a hint for further changing the setting in addition to the information 910. An OK key 907 is a key that the user uses when closing a pup-up containing the information 910. Returning to the description of FIG. 12, in step S1206, the CPU 111 cancels the job to prevent the print processing from being performed, and then ends the processing. The processing illustrated in FIG. 12 may be configured to return to step S1201 if the OK key 907 is pressed. In this case, a display such as "READY TO COPY" illustrated in FIG. 9A can also be changed to a display such as "THE SETTING SHOULD BE CHANGED".

On the other hand, in step S1207, the CPU 111 determines whether the binding is specified for the job. If any type of the binding is specified (YES in step S1207), the processing proceeds to step S1210. If the binding is not specified (NO in step S1207), the processing proceeds to step S1208. In step S1208, the CPU 111 controls the reading unit 118 and the print unit 120 to perform the copy processing based on the copy settings, and then ends the copy processing.

In step S1210, the CPU 111 determines whether the binding method specified for the job is the binding method using no staple. If the specified binding method is the binding method using the staple non-use binding unit 314*b* (YES in step S1210), the processing proceeds to step S1213. If the specified binding method is not the binding method using the staple non-use binding unit 314*b* (if the specified binding method is the binding using a staple) (NO in step S1210), the processing proceeds to step S1211.

In step S1211, the CPU 111 controls the reading unit 118 and the print unit 120 to perform the copy processing based on the copy settings. At this time, the CPU 111 prints the images read by the reading unit 118 while rotating the images if necessary according to the binding position(s) of the corner binding or the double binding set to the job.

In step S1212, the CPU 111 controls the sheet processing unit 122 to perform the binding processing using a staple or staples. If the binding processing specified for the job is the double binding, the sheet processing unit 122 displaces the staple use binding unit 314*a* and drives staples through the sheet bundle at a first position and a second position on the trailing edge thereof, thereby performing the binding processing. On the other hand, if the binding processing specified for the job is the corner binding, the sheet processing unit 122 displaces the staple use binding unit 314*a* according to the binding position and drives a staple through the sheet bundle at this binding position, thereby performing the binding processing. Then, the CPU 111 discharges the sheets bound by the binding processing onto the discharge unit 307, and then ends the processing.

On the other hand, in step S1213, the CPU 111 determines whether the binding position specified for the job is the lower left corner or the upper right corner. If the specified binding position is the lower left corner or the upper right corner (YES in step S1213), the processing proceeds to step S1214. If the specified binding position is not the lower left corner or the upper right corner (if the specified binding position is the upper left corner or the lower right corner) (NO in step S1213), the processing proceeds to step S1216.

In step S1214, the CPU 111 controls the reading unit 118 and the print unit 120 to perform the copy processing as the reverse order printing. In this case, the CPU 111 starts printing the images after reading all documents by the reading unit 118, to achieve the reverse order printing. Further, when printing the images by the print unit 120, the CPU 111 prints the images read by the reading unit 118 while rotating the images if necessary according to the binding position set to the job.

In step S1215, the CPU 111 controls the sheet processing unit 122 to perform the binding processing using no staple. The sheet processing unit 122 performs the binding processing at the fixed position by the staple non-use binding unit 314*b*. Then, the CPU 111 discharges the sheet bundle bound by the binding processing onto the discharge unit 307, and then ends the processing.

In step S1216, the CPU 111 controls the reading unit 118 and the print unit 120 to perform the copy processing as the normal order printing. When printing the images by the print unit 120, the CPU 111 prints the images read by the reading unit 118 while rotating the images if necessary according to the binding position set to the job.

In step S1217, the CPU 111 controls the sheet processing unit 122 to perform the binding processing at the fixed position by the staple non-use binding unit 314*b*. Then, the CPU 111 discharges the sheet bundle bound by the binding processing onto the discharge unit 307, and then ends the processing.

In the present exemplary embodiment, the exclusion processing performed when the copy job is set has been described based on, as one example thereof, the control performed when the copy job is set regarding the sheet selection after being set regarding the binding processing as illustrated in FIG. 13, but is not limited thereto. For example, the MFP 101 may control the operation in such a manner that the sheet is selected first, and then the copy job is set regarding the binding processing after that. In this case, the exclusion processing can be realized by displaying the staple-free binding key 1004, which corresponds to the binding processing using no staple, in the gray-out manner, if the non-reversible sheet has been selected. Further, in the present exemplary embodiment, the exclusion processing has been described assuming that this processing is performed when the copy job is set, by way of example, but is not limited thereto. The exclusion processing can also be applied to, for example, the print settings about the print data in the PC 102.

In this manner, in the present exemplary embodiment, the MFP 101 can control the operation so as to permit either binding processing to be performed, if the sheet to be processed is the sheet reversible in the reversing path 310 when carrying out the copy. Further, the MFP 101 can control the operation so as to prohibit the binding processing from being performed by the binding unit 314*b* configured to perform the binding processing at the fixed single position, if the sheet to be processed is the sheet non-reversible in the reversing path 310. As a result, the MFP 101 can perform the binding processing according to the binding unit 314*a* or 314*b* while preventing the reduction in the quality of the printout, in such an environment that the binding unit 314*b*, which is configured to perform the binding processing at the fixed single position, and the binding unit 314*a*, which is capable of performing the binding processing at the plurality of positions by being displaced, are mixed together.

Further, the MFP 101 can switch whether to receive the setting of the non-reversible sheet between when the specified binding processing is the binding processing by the binding unit 314*b* configured to perform the binding processing at the fixed single position, and when the specified binding processing is the binding processing by the binding unit 314*a* capable of performing the binding processing at the plurality of positions by being displaced. Therefore, the user can appropriately select the sheet to be used in the printing when the printing includes the binding processing.

The above-described first exemplary embodiment has been described as the configuration that prohibits the binding processing from being performed by the binding unit 314*b* configured to perform the binding processing at the fixed single position if the sheet to be processed is the sheet non-reversible in the reversing path 310. A present second exemplary embodiment will be described as a configuration that includes, in addition to the first exemplary embodiment, controlling an operation so as to permit the binding processing to be performed even if the sheet to be processed is the sheet non-reversible in the reversing path 310, as long as the sheet will be able to be discharged without being reversed.

In the second exemplary embodiment, a hardware configuration of an apparatus based on which the second exemplary embodiment is constructed is similar to the first exemplary embodiment. Similar features of the second exemplary embodiment to the first exemplary embodiment will not be described in detail below.

When a user selects the copy function via the home screen (not illustrated), the CPU 111 executes the flowchart of FIG. 12.

Figure 16:
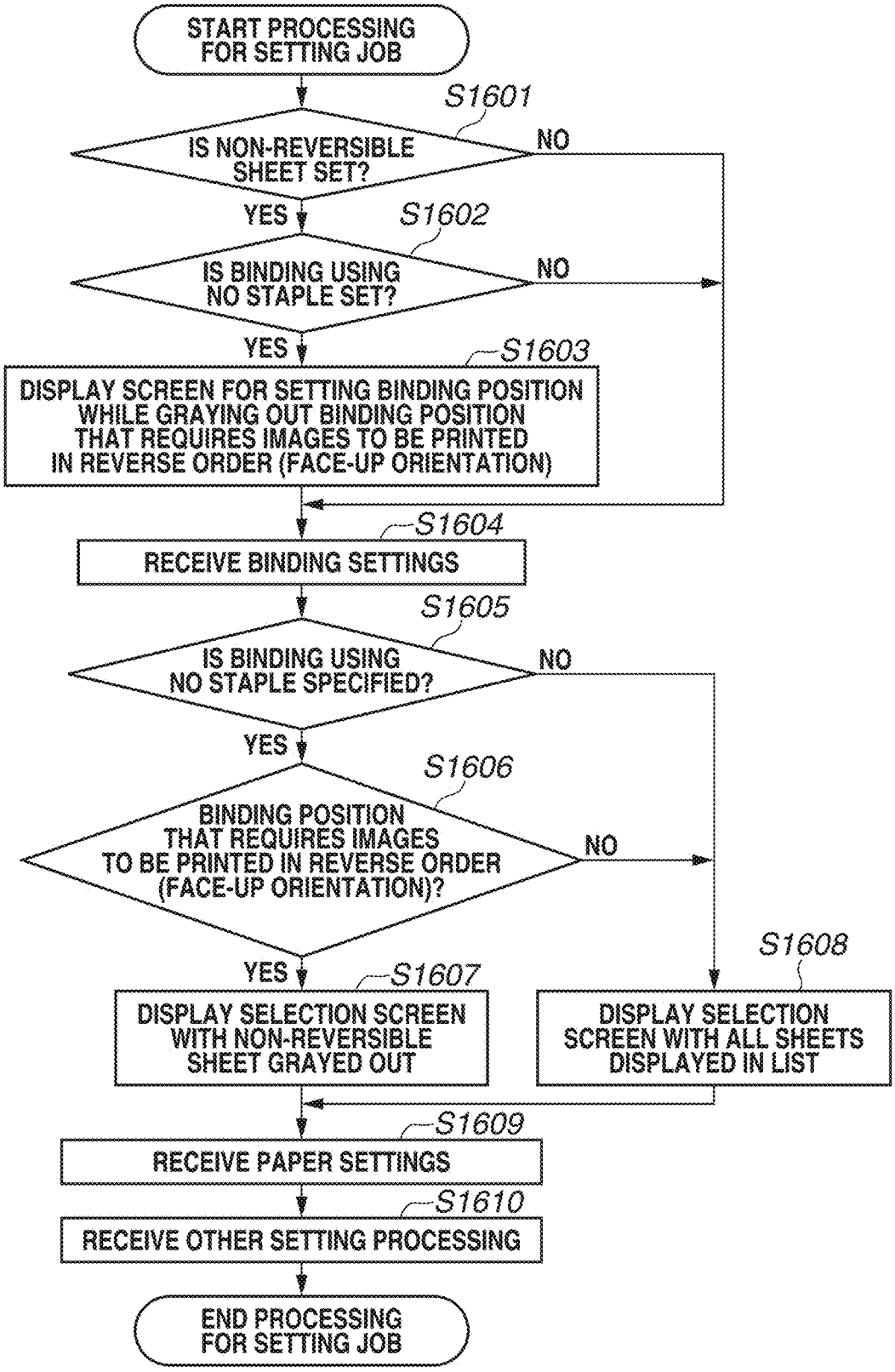
FIG. 16 is a flowchart illustrating a method for controlling the print processing.

In step S1201, the CPU 111 receives settings of a copy job via the panel 201. Details thereof will be described with reference to a flowchart of FIG. 16. FIG. 16 illustrates one example of exclusion processing performed when the copy job is set, which is performed in place of the flowchart of FIG. 13 according to the first exemplary embodiment.

In step S1601, the CPU 111 determines whether the non-reversible sheet is set as the sheet to be used in printing. If the CPU 111 determines that the non-reversible sheet is set (YES in step S1601), the processing proceeds to step S1602. If the CPU 111 determines that the reversible sheet is set (NO in step S1601), the processing proceeds to step S1604.

In step S1602, the CPU 111 determines whether the setting of the binding using no staple is selected. More specifically, if the next key 1006 is touched with the staple-free binding key 1004 selected (YES in step S1602), the processing proceeds to step S1603. If not (NO in step S1602), the processing proceeds to step S1604.

Figure 15:
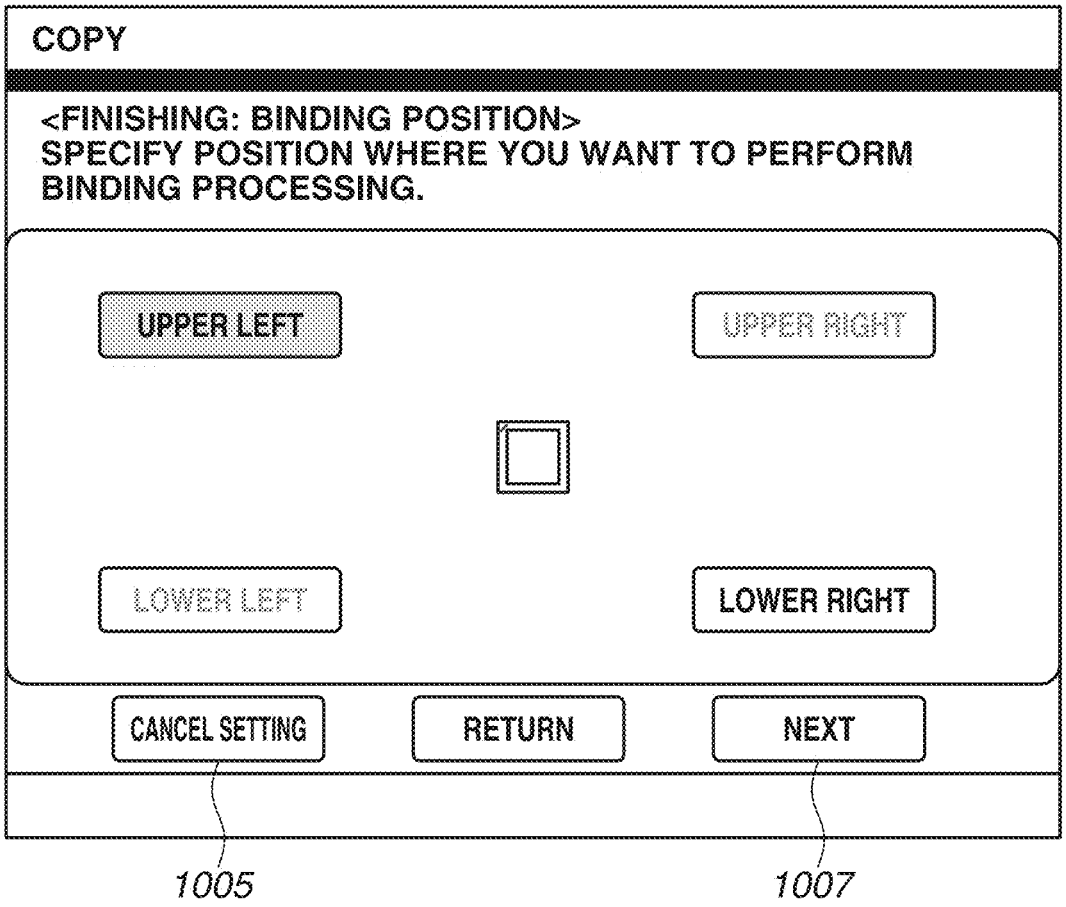
FIG. 15 illustrates an operation screen displayed on the panel.

In step S1603, the CPU 111 displays a screen for setting the binding position while graying out the binding position that requires images to be printed in the reverse order (the face-up orientation). FIG. 15 illustrates an operation screen that the CPU 111 displays on the panel 201 in step S1603, and illustrates this screen with the upper left corner selected as the binding position. Further, the upper right binding position and the lower left binding position are displayed in the gray-out manner so as to prohibit the user from selecting them.

In step S1604, the CPU 111 receives the settings of the binding processing that have been specified via the screens illustrated in FIGS. 10A, and 10B or 15. In step S1605, the CPU 111 determines whether the binding using no staple is specified for the job. If the binding using no staple is specified (YES in step S1605), the processing proceeds to step S1606. If the binding using no staple is not specified (NO in step S1605), the processing proceeds to step S1608.

In step S1606, the CPU 111 determines whether the binding position specified for the job is the binding position that requires images to be printed in the reverse order (the face-up orientation). More specifically, if the binding position is set to the upper right corner or the lower left corner, the CPU 111 determines that the binding position is the binding position that requires the images to be printed in the reverse order (the face-up orientation) (YES in step S1606). Then, the processing proceeds to step S1607. On the other hand, if the binding position is not set to the upper right corner or the lower left corner (if the binding position is set to the upper left corner or the lower right corner) (NO in step S1606), the processing proceeds to step S1608. Steps S1607 to S1610 are similar control to steps S1303 to S1306 described in the first exemplary embodiment, and therefore will not be described in detail here. After the processing for setting the job is performed in steps S1601 to S1610, the processing illustrated in FIG. 12 proceeds to step S1202. Further, how the processing is performed in step S1202 and the steps after that is similar to the first exemplary embodiment, and therefore will not be described here.

In this manner, the second exemplary embodiment includes, in addition to the first exemplary embodiment, controlling the operation so as to permit the binding processing to be performed by the binding unit 314*b* configured to perform the binding processing at the fixed single position even if the sheet to be processed is the non-reversible sheet, depending on the specified binding position, when the copy is set. This control allows the job using the non-reversible sheet to be carried out even if the binding using no staple is set, for the binding position where the binding processing can be performed without requiring the sheets to be reversed.

The above-described first and second exemplary embodiments have been described as the configurations that perform the setting control and the print control according to the specified binding position and the binding unit 314*a* or 314*b* that performs the specified binding processing with respect to the copy function included in the MFP 101. A present third exemplary embodiment will be described as a configuration that includes print control performed when print processing is performed after print data is received from the information processing apparatus, such as the PC 102.

In the print processing based on print data, there are a mode of starting printing print data after completing the analysis of the print data, and a mode of starting printing print data before completing the analysis of the print data. In the present exemplary embodiment, the MFP 101 is assumed to allow the user to set any of the modes in advance as a setting regarding an operation of the MFP 101.

These modes will be briefly described. The mode of starting printing print data after completing the analysis of the print data can reduce a print interval between pages after the first page, although it takes time until the MFP 101 starts printing the first page. Further, this mode can reduce a time period during which the print unit 120 is occupied, thereby allowing the MFP 101 to fulfill another function (for example, outputting a copy) during the analysis of the print data. On the other hand, the mode of starting printing print data before completing the analysis of the print data can realize a faster output of the printout, although the print unit 122 is occupied for a longer time period.

Figure 17:
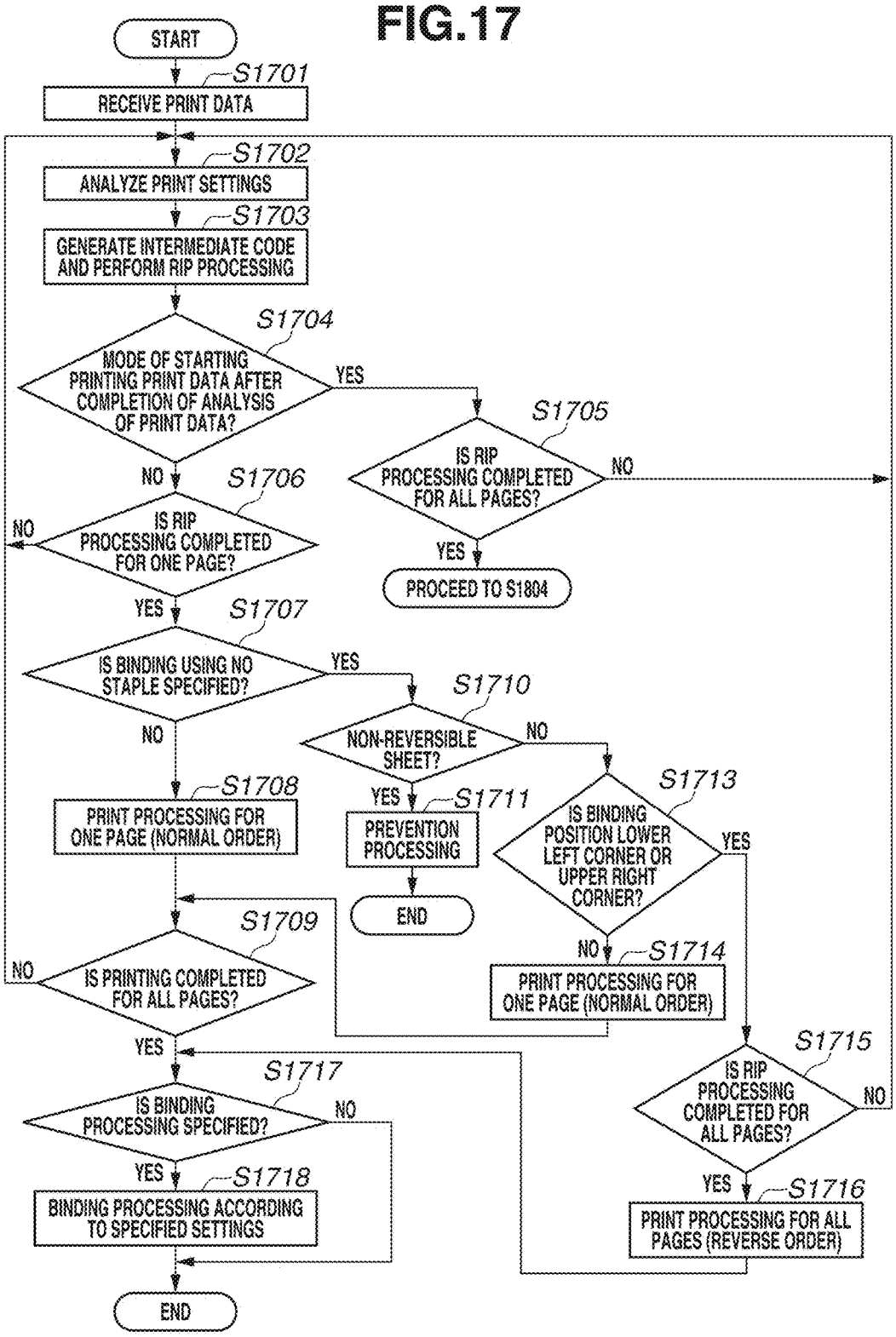
FIG. 17 is a flowchart illustrating a method for controlling the print processing.
Figure 18:
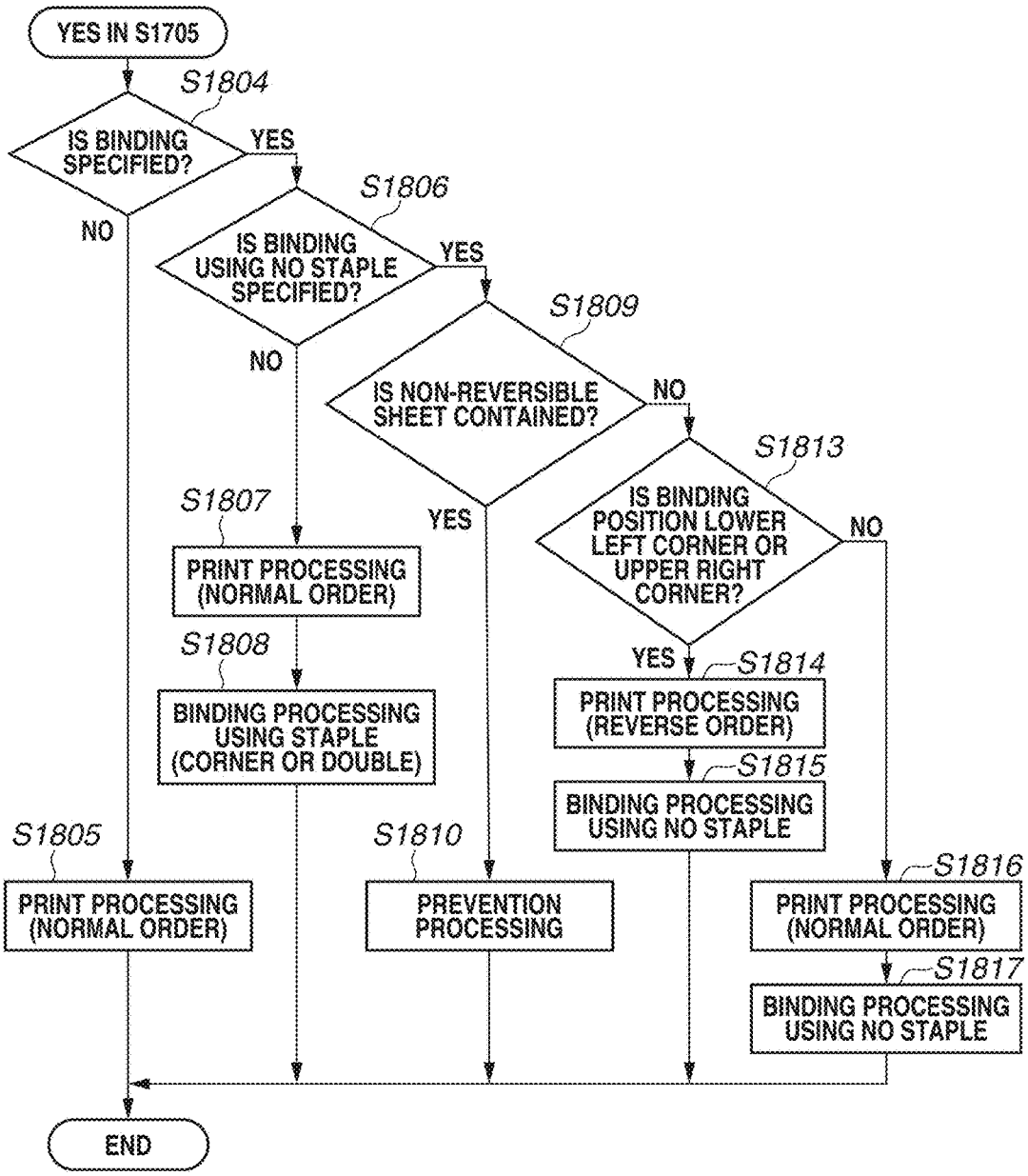
FIG. 18 is a flowchart illustrating the method for controlling the print processing.

FIGS. 17 and 18 are flowcharts illustrating the print processing performed by the MFP 101. Upon receiving print data from the PC 102, a print server (not illustrated), or the like, the CPU 111 executes a control program corresponding to the flowchart of FIG. 17.

In step S1701, the CPU 111 receives print data transmitted from the information processing apparatus, such as the PC 102. The print data received by the MFP 101 is temporarily stored in the storage 114, the RAM 113, or the like.

In step S1702, the CPU 111 analyzes the print data received in step S1701. The CPU 111 stores, into the RAM 113 or the like, the settings regarding the print attributes (hereinafter referred to as the print settings) that are acquired from the analysis of the print data. The print settings stored in the RAM 113 are referred to when necessary in steps that will be described below.

The print data includes a code regarding the print attributes and a code regarding the rendering, and the code regarding the print attributes and the code regarding the rendering are mixed together therein. The code regarding the print attributes of pages to be printed from now is written at the head of the print data. Further, the code regarding the print attributes may also be written in the middle of the print data. Such a code is used, for example, when the user wants to change a sheet type and/or a sheet size from a page in the middle of a printout.

In step S1703, the CPU 111 generates an intermediate code from the print data. Further, the RIP 125 generates image data to be used in the printing from the intermediate code based on the print settings stored in step S1702.

In step S1704, the CPU 111 determines whether the MFP 101 is set to the mode of starting printing the print data after completing the analysis of the print data as the setting about the operation of the print apparatus. If the MFP 101 is set to the mode of starting printing the print data after completing of the analysis of the print data (YES in step S1704), the processing proceeds to step S1705. On the other hand, if the MFP 101 is not set to the mode of starting printing the print data after completing the analysis of the print data (if the MFP 101 is set to the mode of starting printing the print data before completing the analysis of the print data (NO in step S1704), the processing proceeds to step S1706.

In step S1705, the CPU 111 determines whether RIP processing is completed for all of the pages. If not the RIP processing is completed for all of the pages (NO in step S1705), the processing returns to step S1702. Then, the CPU 111 analyzes the print data, and the RIP 125 generates the image data. On the other hand, if the RIP processing is completed for all of the pages (YES in step S1705), the processing proceeds to step S1804.

Step S1804 and steps after that indicate print control performed if the MFP 101 is set to the mode of starting printing the print data after completing the analysis of the print data. First, the print control in this case will be described.

In step S1804, the CPU 111 determines whether the binding is specified in the print settings. If any type of the binding is specified (YES in step S1804), the processing proceeds to step S1806. If the binding is not specified (NO in step S1804), the processing proceeds to step S1805. In step S1805, the CPU 111 controls the print unit 120 to perform the print processing based on the print settings, and then ends the print control.

In step S1806, the CPU 111 determines whether the binding method specified in the print settings is the binding method using no staple. If the specified binding method is the binding method using the staple non-use binding unit 314*b* (YES in step S1806), the processing proceeds to step S1809. If the specified binding method is not the binding method using the staple non-use binding unit 314*b* (if the specified binding method is the binding using a staple) (NO in step S1806), the processing proceeds to step S1807.

In step S1807, the CPU 111 controls the print unit 120 to perform the print processing based on the print settings. At this time, the CPU 111 prints the images analyzed in step S1703 while rotating the images if necessary according to the binding position(s) specified as the print setting. In step S1808, the CPU 111 performs the binding processing using a staple or staples in a similar manner to step S1212 in the first exemplary embodiment, and then ends the print control.

On the other hand, in step S1809, the CPU 111 determines whether the non-reversible sheet is contained as the sheet type to be used in the printing. If the non-reversible sheet is contained (YES in step S1809), the processing proceeds to step S1810. If the non-reversible sheet is not contained (NO in step S1809), the processing proceeds to step S1813.

In step S1810, the CPU 111 prevents the non-reversible sheet from being fed and conveyed to the print unit 120. As one example of the prevention processing performed at this time, the CPU 111 can perform control of canceling the print processing. When canceling the printing, the MFP 101 may delete this print data, or may keep the print data in a print queue in an error state. Further, the MFP may be configured to prompt the user to input a change in the setting for changing the sheet via the panel 201. In this case, if the sheet selection is changed to the reversible sheet, the processing proceeds to step S1813.

On the other hand, in step S1813, the CPU 111 determines whether the binding position specified as the print setting is the lower left corner or the upper right corner. If the specified binding position is the lower left corner or the upper right corner (YES in step S1813), the processing proceeds to step S1814. If the specified binding position is not the lower left corner or the upper right corner (if the specified binding position is the upper left corner or the lower right corner) (NO in step S1813), the processing proceeds to step S1816.

In step S1814, the CPU 111 controls the print unit 120 to print the images as the reverse order printing. Further, when printing the images by the print unit 120, the CPU 111 prints the images generated in step S1703 while rotating the images if necessary according to the binding position specified as the print setting.

In step S1815, the CPU 111 controls the sheet processing unit 122 to perform the binding processing by the staple non-use binding unit 314*b*. Then, the CPU 111 discharges the sheet bundle bound by the binding processing onto the discharge unit 307, and then ends the processing.

In step S1816, the CPU 111 controls the reading unit 118 and the print unit 120 to print the images as the normal order printing. Further, when printing the images by the print unit 120, the CPU 111 prints the images generated in step S1703 while rotating the images if necessary according to the binding position set to the job.

In step S1817, the CPU 111 controls the sheet processing unit 122 to perform the binding processing by the staple non-use binding unit 314*b*. Then, the CPU 111 discharges the sheet bundle bound by the binding processing onto the discharge unit 307, and then ends the processing.

In this manner, the mode of starting printing the print data after completing the analysis of the print data allows the MFP 101 to perform the prevention processing without starting printing the print data, even if the non-reversible sheet is mixed in the middle of the print data.

Returning to the description of FIG. 17, next, the processing will be described focusing on print control performed when the MFP 101 operates in the mode of starting printing the print data before completing the analysis of the print data.

In step S1706, the CPU 111 determines whether the RIP processing is completed for one page. If the RIP processing is completed for one page (YES in step S1706), the processing proceeds to step S1707. If the RIP processing is not completed for one page (NO in step S1706), the processing returns to step S1702. Then, the CPU 111 analyzes the print data, and the RIP 125 generates the image data.

In step S1707, the CPU 111 determines whether the binding using no staple is specified in the print settings. If the binding using no staple is specified (YES in step S1707), the processing proceeds to step S1710. If the binding using no staple is not specified (the binding using a staple is specified or the binding is not specified) (NO in step S1707), the processing proceeds to step S1708. In step S1708, the CPU 111 controls the print unit 120 to print the image for one page onto the sheet. Further, when printing the image by the print unit 120, the CPU 111 prints the image while rotating the image if necessary according to the print setting. In step S1709, the CPU 111 determines whether the printing is completed for all of the pages. If the CPU 111 determines that the printing is completed for all of the pages (YES in step S1709), the processing proceeds to step S1717. If the CPU 111 determines that not the printing is completed for all of the pages (NO in step S1709), the processing returns to step S1702.

On the other hand, in step S1710, the CPU 111 determines whether the non-reversible sheet is set as the print setting to be applied when this page is to be printed. If the CPU 111 determines that the non-reversible sheet is set (YES in step S1710), the processing proceeds to step S1711. If the CPU 111 determines that the non-reversible sheet is not set (the reversible sheet is set) (NO in step S1710), the processing proceeds to step S1713.

In step S1711, the CPU 111 prevents the non-reversible sheet from being fed and conveyed to the print unit 120. As one example of the prevention processing performed at this time, the CPU 111 can perform the control of canceling the print processing. When canceling the printing, the MFP 101 may delete this print data, or may keep the print data in a print queue in an error state. Further, the MFP may be configured to abort the printing and prompt the user to input a change in the setting for changing the sheet via the panel 201. In this case, if the sheet selection is changed to the reversible sheet, the processing proceeds to step S1713.

In step S1713, the CPU 111 determines whether the binding position specified as the print setting is the lower left corner or the upper right corner. If the specified binding position is the lower left corner or the upper right corner (YES in step S1713), the processing proceeds to step S1715. If the specified binding position is not the lower left corner or the upper right corner (if the specified binding position is the upper left corner or the lower right corner) (NO in step S1713), the processing proceeds to step S1714.

In step S1714, the CPU 111 controls the print unit 120 to print the image for one page onto the sheet. Further, when printing the image by the print unit 120, the CPU 111 prints the image while rotating the image if necessary according to the binding position specified as the print setting. After the image for one page is printed onto the sheet, the processing proceeds to step S1709.

On the other hand, in step S1715, the CPU 111 determines whether the RIP processing is completed for all of the pages contained in the print data. If the RIP processing is completed for all of the pages contained in the print data (YES in step S1715), the processing proceeds to step S1716. If not the RIP processing is completed for all of the pages contained in the print data (NO in step S1715), the processing returns to step S1702. Then, the CPU 111 analyzes the print data, and the RIP 125 generates the image data.

The binding position set to the lower left corner or the upper right corner requires the images to be printed in the reverse order as illustrated in FIG. 8. Therefore, the MFP 101 should start printing the images after the image data for all of the pages is prepared.

In step S1716, the CPU 111 controls the print unit 120 to print all of the images contained in the print data onto the sheets in the reverse order. Further, when printing the images by the print unit 120, the CPU 111 prints the images while rotating the images if necessary according to the binding position specified as the print setting. After completion of the printing for all of the images, the processing proceeds to step S1717.

In step S1717, the CPU 111 determines whether the binding is specified in the print settings. If any type of the binding is specified (YES in step S1717), the processing proceeds to step S1718. If the binding is not specified (NO in step S1717), the CPU 111 discharges the sheet bundle onto the discharge unit 307, and then ends the processing.

In step S1718, the CPU 111 controls the sheet processing unit 122 to perform the binding processing according to the specified binding. Specific control of the binding processing is similar to steps S1212 and S1215 in the first exemplary embodiment, and therefore will not be described here. The CPU 111 discharges the sheet bundle bound by the binding processing onto the discharge unit 307, and then ends the processing.

The MFP 101 may be configured to perform the processing for preventing the non-reversible sheet from being fed and conveyed in steps S1710 and S1711 after determining the binding position in step S1713. In this case, the MFP 101 is configured to perform the prevention processing in steps S1710 and S1711, if the binding position is the lower left corner or the upper right corner (YES in step S1713), i.e., if the sheet should be reversed to be output in the face-up orientation. On the other hand, the MFP 101 is configured to be able to perform the binding processing without performing the prevention processing, if the binding position is the upper left corner or the lower right corner (NO in step S1713), i.e., if the sheet does not have to be reversed. Further, similarly, the MFP 101 may be configured to perform the prevention processing in steps S1809 and S1810 after determining the binding position in step S1813.

Further, in the present exemplary embodiment, the MFP 101 is configured to start analyzing the print data after completing the reception of the print data in step S1701. However, the analysis of the print data is not limited thereto, and the MFP 101 may be configured to start analyzing the print data from the head of the print data while receiving the print data.

In this manner, in the present exemplary embodiment, the MFP 101 can control the operation so as to permit either binding processing to be performed if the sheet to be processed is the sheet reversible in the reversing path 310 when performing the print processing. Further, the MFP 101 can control the operation so as to prohibit the binding processing from being performed by the binding unit 314*b* configured to perform at the fixed single position if the sheet to be processed is the non-reversible sheet. As a result, the MFP 101 can perform the binding processing according to the binding unit 314*a* or 314*b* while preventing the reduction in the quality of the printout, in such an environment that the binding unit 314*b*, which is configured to perform the binding processing at the fixed single position, and the binding unit 314*a*, which is capable of performing the binding processing at the plurality of positions by being displaced, are mixed together.

Further, the MFP 101 can control the operation so as to prohibit the binding processing from being performed before printing the print data onto the sheets, if starting printing the print data after completing the analysis of the print data. Furthermore, the MFP 101 can control the operation so as to also prohibit the binding processing from being performed for the sheet that cannot be appropriately reversed when the non-reversible sheet is mixed in the print data while speeding up the output of the printout, if starting printing the print data before completing the analysis of the print data.

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s), and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to aspects of the present invention, the print apparatus can prevent the reduction in the quality of the printout by performing the control according to the binding position and the binding unit that performs the specified binding processing.

While aspects of the present invention have been described with reference to exemplary embodiments, it is to be understood that the aspects of the invention are not limited to the disclosed exemplary embodiments. The scope of the following claims is to be accorded the broadest interpretation so as to encompass all such modifications and equivalent structures and functions.

This application claims the benefit of Japanese Patent Application No. 2014-263182, filed Dec. 25, 2014, which is hereby incorporated by reference herein in its entirety.

What is claimed is:

1. A print apparatus that binds sheets at corners thereof after images are printed onto the sheets, the print apparatus comprising:

a print unit configured to print images onto the sheets;

a sheet binding unit configured to perform binding processing at specified corners using any of a first binding unit that performs the binding processing by being displaced to a plurality of positions, and a second binding unit that performs the binding processing at a fixed single position;

a reversing unit configured to reverse the sheets via a conveyance path provided for reversing the sheets; and a control unit configured to cause the binding processing to be performed on the sheets that are not reversed by the reversing unit in a case where the binding processing is performed at predetermined corners using the first binding unit, and cause the binding processing to be performed on the sheets that are reversed by the reversing unit in a case where the binding processing is performed at the predetermined corners using the second binding unit, wherein the control unit further permits execution of the binding processing using the first binding unit or the second binding unit in a case where the sheets to be used when the print unit prints the images are sheets of a type permitted to be reversed by the reversing unit, and permits execution of the binding processing using the first binding unit while prohibiting execution of the binding processing with use of the second binding unit in a case where the sheets to be used when the print unit prints the images are sheets of a type prohibited from being reversed by the reversing unit.

2. The print apparatus according to claim 1, further comprising a reception unit configured to receive a setting of print processing, wherein, when the reception unit receives the setting of the print processing, the control unit, in a case where execution of the binding processing with use of the second binding unit is specified for the print processing in advance, controls the reception unit to prevent the sheets of the type prohibited from being reversed by the reversing unit from being specified as the sheets to be used in the print processing.

3. The print apparatus according to claim 1, further comprising a reception unit configured to receive a setting of print processing, wherein, when the reception unit receives the setting of the print processing, the control unit, in a case where printing the images onto the sheets of the type prohibited from being reversed by the reversing unit is specified for the print processing in advance, controls the reception unit to prevent the binding processing with use of the second binding unit from being specified.

4. The print apparatus according to claim 1, wherein the control unit permits, in a case where the specified corners are corners where the binding processing with use of the second binding unit can be performed without requiring the sheets to be reversed by the reversing unit execution of the binding processing with use of the second binding unit even when the sheets to be used when the print unit prints the images are the sheets of the type prohibited from being reversed by the reversing unit.

5. The print apparatus according to claim 4, further comprising a reception unit configured to receive a setting of print processing, wherein, when the reception unit receives the setting of the print processing, the control unit controls, in a case where execution of the binding processing with use of the second binding unit is specified for the print processing in advance and the corners specified in advance are corners where the binding processing with use of the second binding unit can be performed with the aid of the reversal of the sheets by the reversing unit, the reception unit so as to prevent the sheets of the type prohibited from being reversed by the reversing unit from being specified as the sheets to be used in the print processing.

6. The print apparatus according to claim 4, further comprising a reception unit configured to receive a setting of print processing, wherein, when the reception unit receives the setting of the print processing, the control unit controls, in a case where execution of the binding processing with use of the second binding unit is specified for the print processing in advance and printing the images onto the sheets of the type prohibited from being reversed by the reversing unit is specified for the print processing in advance, the reception unit so as to prevent corners where the binding processing with use of the second binding unit can be performed with the aid of the reversal of the sheets by the reversing unit from being specified.

7. The print apparatus according to claim 1, wherein the control unit, in a case where the print unit prints the images onto both sides of the sheets and the sheets to be used in this printing are the sheets of the type prohibited from being reversed by the reversing unit, cancels print processing by the print unit.

8. The print apparatus according to claim 1, further comprising a reception unit configured to receive print data from an external apparatus, wherein, when the print unit prints the images based on the received print data, the control unit cancels the printing of the images based on the received print data, in a case where printing the images with use of the sheets of the type prohibited from being reversed by the reversing unit is specified and the execution of the binding processing with use of the second binding unit is specified as settings of this print data.

9. A method for controlling a print apparatus that binds sheets at corners thereof after images are printed onto the sheets, the method for controlling the print apparatus comprising:

printing images onto the sheets;

performing binding processing at specified corners using any of a first binding unit that performs the binding processing by being displaced to a plurality of positions, and a second binding unit that performs the binding processing at a fixed single position;

reversing the sheets via a conveyance path provided for reversing the sheets; and performing control to cause the binding processing to be performed on the sheets that are not reversed by the reversing in a case where the binding processing is performed at predetermined corners using the first binding unit, and cause the binding processing to be performed on the sheets that are reversed by the reversing in a case where the binding processing is performed at the predetermined corners using the second binding unit, wherein the control further includes permitting execution of the binding processing using the first binding unit or the second binding unit in a case where the sheets to be used when the printed images are sheets of a type permitted to be reversed by the reversing, and permitting execution of the binding processing using the first binding unit while prohibiting execution of the binding processing using the second binding unit in a case where the sheets to be used when the images are printed are sheets of a type prohibited from being reversed by the reversing.

10. A non-transitory computer-readable storage medium storing computer executable instructions for causing a computer to execute a method for controlling a print apparatus, the method comprising:

printing images onto the sheets;

performing binding processing at specified corners using any of a first binding unit that performs the binding processing by being displaced to a plurality of positions, and a second binding unit that performs the binding processing at a fixed single position;

reversing the sheets via a conveyance path provided for reversing the sheets; and performing control to cause the binding processing to be performed on the sheets that are not reversed by the reversing in a case where the binding processing is performed at predetermined corners using the first binding unit, and cause the binding processing to be performed on the sheets that are reversed by the reversing in a case where the binding processing is performed at the predetermined corners using the second binding unit, wherein the control further includes permitting execution of the binding processing using the first binding unit or the second binding unit in a case where the sheets to be used when the printed images are sheets of a type permitted to be reversed by the reversing, and permitting execution of the binding processing using the first binding unit while prohibiting execution of the binding processing using the second binding unit in a case where the sheets to be used when the images are printed in the printing are sheets of a type prohibited from being reversed by the reversing.

* * * * *